US008959918B2

(12) United States Patent
Nishikawa et al.

(10) Patent No.: US 8,959,918 B2
(45) Date of Patent: Feb. 24, 2015

(54) HYBRID CONSTRUCTION MACHINE

(75) Inventors: Shinji Nishikawa, Kasumigaura (JP); Takenori Hiroki, Ibaraki-ken (JP); Kouji Ishikawa, Kasumigaura (JP); Manabu Edamura, Kasumigaura (JP); Hidetoshi Satake, Ishioka (JP); Takatoshi Ooki, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 65 days.

(21) Appl. No.: 13/642,621

(22) PCT Filed: Jul. 20, 2011

(86) PCT No.: PCT/JP2011/066483

§ 371 (c)(1),
(2), (4) Date: Oct. 22, 2012

(87) PCT Pub. No.: WO2012/011504

PCT Pub. Date: Jan. 26, 2012

(65) Prior Publication Data

US 2013/0174556 A1 Jul. 11, 2013

(30) Foreign Application Priority Data

Jul. 23, 2010 (JP) ..... 2010-166409

(51) Int. Cl.
*F02B 73/00* (2006.01)
*E02F 9/20* (2006.01)
(Continued)

(52) U.S. Cl.
CPC ..... *E02F 9/2004* (2013.01); *E02F 9/123* (2013.01); *E02F 9/2075* (2013.01); *E02F 3/965* (2013.01);
(Continued)

(58) Field of Classification Search
CPC ..... E02F 9/205; E02F 3/965; E02F 9/123; E02F 9/2075; E02F 9/2095; E02F 9/2296; E02F 9/26; E02F 9/2004; E02F 9/22
USPC ..... 60/414, 427, 433, 716–718; 701/50; 180/65.21, 65.23, 65.27; 414/699
See application file for complete search history.

(56) References Cited

U.S. PATENT DOCUMENTS

| | | | | |
|---|---|---|---|---|
| 6,778,097 | B1 * | 8/2004 | Kajita et al. | 340/12.5 |
| 2007/0164873 | A1 * | 7/2007 | Yamada et al. | 340/679 |
| 2008/0040007 | A1 * | 2/2008 | Bertsch et al. | 701/50 |
| 2008/0317574 | A1 * | 12/2008 | Moriya et al. | 414/687 |
| 2009/0166106 | A1 * | 7/2009 | Batdorf | 180/24.06 |

FOREIGN PATENT DOCUMENTS

| | | | |
|---|---|---|---|
| JP | 2001-016704 | A | 1/2001 |
| JP | 2004-124381 | A | 4/2004 |

(Continued)

OTHER PUBLICATIONS

Machine Translation of JP 2005290882 A (2008).*

*Primary Examiner* — Thomas Denion
*Assistant Examiner* — Mickey France
(74) *Attorney, Agent, or Firm* — Mattingly & Malur, PC

(57) ABSTRACT

A hybrid construction machine has an electric motor for driving the swing structure, and the electric motor is prevented from becoming incapable of generating torque due to a low energy state or an overcharged state of an electricity storage device. A swing-mode selector switch 77 which is manually operated switches between a hydraulic/electric combined swing mode for driving the swing structure by driving both the electric motor and a hydraulic motor and a hydraulic solo swing mode for driving the swing structure by driving only the hydraulic motor. For a normal operation, the swing mode is initially set in the hydraulic/electric combined swing mode. For a specific operation, the operator switches the swing-mode selector switch from a hydraulic/electric combined swing position to a hydraulic solo swing position.

11 Claims, 25 Drawing Sheets

(51) Int. Cl.

| | |
|---|---|
| ***E02F 9/12*** | (2006.01) |
| ***E02F 3/96*** | (2006.01) |
| ***E02F 9/22*** | (2006.01) |
| ***E02F 9/26*** | (2006.01) |

(52) U.S. Cl.

CPC ..... *E02F 9/205* (2013.01); *E02F 9/2095* (2013.01); *E02F 9/2296* (2013.01); *E02F 9/26* (2013.01); *E02F 9/2058* (2013.01); *E02F 9/22* (2013.01)

USPC ..... 60/718; 180/65.21

(56) References Cited

FOREIGN PATENT DOCUMENTS

| | | | | | |
|---|---|---|---|---|---|
| JP | 2004-360216 | A | | 12/2004 | |
| JP | 3647319 | B2 | | 5/2005 | |
| JP | 2005-290882 | A | | 10/2005 | |
| JP | 2005290882 | A | * | 10/2005 | ..... E02F 9/22 |
| JP | 4024120 | B2 | | 12/2007 | |
| JP | 2008-063888 | A | | 3/2008 | |

* cited by examiner

HYBRID CONSTRUCTION MACHINE

TECHNICAL FIELD

The present invention relates to a hybrid construction machine. The invention particularly relates to a hybrid construction machine having a swing structure such as a hydraulic shovel.

BACKGROUND ART

A construction machine such as a hydraulic shovel employs fuel (gasoline, light oil, etc.) as the power source of its engine and drives hydraulic actuators (hydraulic motor, hydraulic cylinder, etc.) using hydraulic pressure generated by a hydraulic pump which is driven by the engine. Being small-sized, lightweight and capable of outputting high power, the hydraulic actuators are widely used as actuators for construction machines.

Meanwhile, there has recently been proposed a construction machine employing an electric motor and an electricity storage device (battery, electric double layer capacitor, etc.) and thereby realizing higher energy efficiency and more energy saving compared to conventional construction machines employing hydraulic actuators only (Patent Literature 1).

Electric motors (electric actuators) have some excellent features in terms of energy, such as higher energy efficiency compared to hydraulic actuators and the ability to regenerate electric energy from kinetic energy at the time of braking. The kinetic energy is released and lost as heat in the case of hydraulic actuators.

For example, the Patent Literature 1 discloses an embodiment for practicing a hydraulic shovel having an electric motor as the actuator for driving the swing structure. The actuator for driving and rotating the upper swing structure of the hydraulic shovel with respect to the lower travel structure (implemented by a hydraulic motor in conventional hydraulic shovels) is used frequently and repeats activation/stoppage and acceleration/deceleration frequently at work.

When a hydraulic actuator is used for driving the swing structure, the kinetic energy of the swing structure in deceleration (braking) is lost as heat in the hydraulic circuit. In contrast, energy saving can be realized by use of an electric motor since regeneration of the kinetic energy into electric energy is possible.

There have also been proposed construction machines that are equipped with both a hydraulic motor and an electric motor so as to drive the swing structure by total torque of the hydraulic motor and the electric motor (Patent Literatures 2 and 3).

The Patent Literature 2 discloses an energy regeneration device for a hydraulic construction machine in which an electric motor is connected directly to the hydraulic motor for driving the swing structure. A controller determines the output torque of the electric motor based on the operation amount of the control lever and sends an output torque command to the electric motor. In deceleration (braking), the electric motor regenerates the kinetic energy of the swing structure into electric energy and accumulates the regenerated energy in a battery.

The Patent Literature 3 discloses a hybrid construction machine which performs output torque splitting between the hydraulic motor and the electric motor by calculating a torque command value for the electric motor using the differential pressure between the inlet side and the outlet side of the hydraulic motor for the swing driving.

Both of the conventional techniques of the Patent Literatures 2 and 3 employ an electric motor and a hydraulic motor together as the actuators for the swing driving and thereby realize operation with no feeling of strangeness even for operators accustomed to conventional construction machines driven by a hydraulic actuator, as well as achieving energy saving with a simple and easy configuration for practical use.

PRIOR ART LITERATURE

Patent Literature

Patent Literature 1: Japanese Patent No. 3647319
Patent Literature 2: Japanese Patent No. 4024120
Patent Literature 3: JP,A 2008-63888

SUMMARY OF THE INVENTION

Problem to be Solved by the Invention

In the hybrid hydraulic shovel described in the Patent Literature 1, the kinetic energy of the swing structure in deceleration (braking) is regenerated by the electric motor into electric energy, which is effective from the viewpoint of energy saving.

However, using an electric motor, having different characteristics from hydraulic motors, for driving the swing structure of a construction machine can cause the following problems:

(1) Hunting (especially in a low speed range, stopped state) due to inappropriate speed feedback control of the electric motor, etc.

(2) Feeling of strangeness about the operation (manipulation) of the construction machine caused by the difference in characteristics from hydraulic motors.

(3) Overheating of the motor or inverter during an operation/work (e.g., pressing operation) that requires continuous torque output with no rotation of the motor.

(4) Excessive increase in the overall size or considerable increase in costs due to the use of an electric motor guaranteeing high output equivalent to that of hydraulic motors.

The hybrid hydraulic shovels described in the Patent Literatures 2 and 3 solve the above problems by employing both a hydraulic motor and an electric motor and driving the swing structure by the total torque of the motors, thereby realizing operation with no feeling of strangeness even for operators accustomed to conventional construction machines driven by a hydraulic actuator, as well as achieving energy saving with a simple and easy configuration for practical use.

However, in every one of the conventional techniques described in the above Patent Literatures 1-3, the electric motor is constantly in charge of a certain part of the total torque necessary for the swing driving. Therefore, when the electric motor is incapable of generating torque for some reason (failure/abnormality in an electric system (inverter, motor, etc.), a low energy state or an overcharged state of the electricity storage device, etc.), the total torque becomes insufficient for driving the swing structure and it becomes impossible to activate/stop the swing structure as in the normal state.

For example, if an abnormality occurs suddenly when the swing structure is rotating at a high speed with high kinetic energy, the electric motor falls into a free running state and cannot be stopped by the conventional technique of the Patent Literature 1. Even with the conventional techniques of the Patent Literatures 2 and 3, the stopping distance and the stopping time increase compared to the normal state, which can lead to a problem in terms of safety.

Such a low energy state or overcharged state of the electricity storage device tends to occur during specific operations.

The low energy state of the electricity storage device occurs when an energy-losing operation (in which the energy that can be recovered during braking is less than the energy required by the electric motor for the driving of the swing structure) continues for a long time. For example, in an operation using a crusher (crusher attachment) as the front attachment, the energy necessary for the swing driving is high due to the heavy weight of the front attachment, whereas the energy that can be recovered and collected in the electricity storage device during braking is low due to low kinetic energy of the swing structure swinging slowly during the crushing operation. Thus, continuing the crushing operation for a long time causes the electricity storage device to fall into the low energy state.

The overcharged state of the electricity storage device occurs when an energy-gaining operation (in which the energy that can be recovered during braking is greater than the energy required by the electric motor for the driving of the swing structure) continues for a long time. For example, there can be an operation for shoveling up a load from a position on a slope and discharging the load to a position down the slope. In such an operation, the energy necessary for the swing driving (i.e., energy consumed from the electricity storage device) is low, whereas energy necessary for the braking (i.e., energy stored in the electricity storage device) is high. Thus, continuing the swing unloading operation for a long time causes the electricity storage device to fall into the overcharged state.

It is therefore the primary object of the present invention to provide a hybrid construction machine (construction machine employing an electric motor for the driving of the swing structure) capable of preventing the electric motor from becoming incapable of generating torque due to a factor like the low energy state or the overcharged state of the electricity storage device.

Means for Solving the Problem (1) To achieve the above object, a hybrid construction machine in accordance with the present invention comprises:

a prime mover;

a hydraulic pump which is driven by the prime mover;

a swing structure;

an electric motor for driving the swing structure;

a hydraulic motor for driving the swing structure, the hydraulic motor being driven by the hydraulic pump;

an electricity storage device which is connected to the electric motor;

a swing control lever device which is operated for commanding the driving of the swing structure;

swing-mode switching command means which is manually operated for commanding switching between:

- a hydraulic/electric combined swing mode for driving the swing structure by total torque of the electric motor and the hydraulic motor by driving both the electric motor and the hydraulic motor when the swing control lever device is operated, and
- a hydraulic solo swing mode for driving the swing structure by the torque of the hydraulic motor alone by driving only the hydraulic motor when the swing control lever device is operated; and a control device which includes a hydraulic/electric combined swing control unit for executing hydraulic/electric combined swing mode control, a hydraulic solo swing control unit for executing hydraulic solo swing mode control, and a swing-mode switching unit for executing the switching between the hydraulic/electric combined swing mode and the hydraulic solo swing mode based on a switching command from the swing-mode switching command means.

In the present invention, the hybrid construction machine comprises both a hydraulic motor and an electric motor for the driving of the swing structure. Based on the switching command from the manually-operated swing-mode switching command means, the control device executes the switching between the hydraulic/electric combined swing mode for driving the swing structure by driving both the hydraulic motor and the electric motor and the hydraulic solo swing mode for driving the swing structure by driving only the hydraulic motor.

Specific operations that tend to cause a problem related to the electricity storage device can be anticipated previously. By switching the swing mode from the hydraulic/electric combined swing mode to the hydraulic solo swing mode and fixing the swing mode before starting the specific operation, the occurrence of the problem related to the electricity storage device can be prevented.

(2) Preferably, the above hybrid construction machine (1) further comprises a selector switch which is arranged in a cab. The control device further includes an input control unit which receives a command inputted from the selector switch. The swing-mode switching command means includes the selector switch and the input control unit of the control device.

With this configuration, the control device executes the switching between the hydraulic/electric combined swing mode and the hydraulic solo swing mode based on the switching command from the selector switch.

(3) Preferably, the above hybrid construction machine (2) further comprises a display device. The control device further includes a display control unit which displays the swing mode as the result of the switching by the swing-mode switching unit on the display device.

With this configuration, the operator is allowed to recognize the currently selected swing mode and prevented from forgetting to set/return the selector switch.

(4) Preferably, the above hybrid construction machine (1) further comprises a display device having an operational input unit. The control device further includes a display control unit which displays a swing-mode selection screen on the display device and an input control unit which receives information on the swing mode selected on the swing-mode selection screen through the operational input unit. The swing-mode switching command means includes the swing-mode selection screen displayed on the display device, the operational input unit of the display device, and the input control unit of the control device.

With this configuration, the control device executes the switching between the hydraulic/electric combined swing mode and the hydraulic solo swing mode based on the switching command that is issued by using the display device as a GUI.

(5) Preferably, in the above hybrid construction machine (4), the display control unit displays the swing mode as the result of the switching by the swing-mode switching unit on the display device.

With this configuration, the operator is allowed to recognize the currently selected swing mode and prevented from forgetting to set/return the selector switch.

(6) Preferably, the above hybrid construction machine (1) further comprises operation mode selection means which includes an operation mode selection unit as a part of the control device. The swing-mode switching command means includes the operation mode selection unit.

With this configuration, the control device executes the switching between the hydraulic/electric combined swing mode and the hydraulic solo swing mode based on the switching command that is automatically outputted in response to the selection of the operation mode.

(7) Preferably, in the above hybrid construction machine (1), the control device further includes an external terminal communication unit which executes input and output from/to an external terminal. The swing-mode switching command means includes the external terminal and the external terminal communication unit of the control device.

With this configuration, the control device executes the switching between the hydraulic/electric combined swing mode and the hydraulic solo swing mode based on the switching command from the external terminal.

(8) Preferably, in the above hybrid construction machine (2), (4) or (6), the control device further includes an external terminal communication unit which executes input and output from/to an external terminal. The hybrid construction machine further comprises second swing-mode switching command means which commands the switching between the hydraulic/electric combined swing mode and the hydraulic solo swing mode while invalidating the command from the swing-mode switching command means via the external terminal communication unit.

With this configuration, the control device executes the switching between the hydraulic/electric combined swing mode and the hydraulic solo swing mode based on the switching command from the swing-mode switching command means or the switching command from the second swing-mode switching command means.

Effect of the Invention

According to the present invention, the swing mode can be switched from the mode for executing the swing driving with the torque of both the hydraulic motor and the electric motor (hydraulic/electric combined swing mode) to the mode for executing the swing driving with the hydraulic motor alone (hydraulic solo swing mode) when a specific operation that tends to cause the low energy state or the overcharged state of the electricity storage device is conducted. By the switching, the operation can be continued with the hydraulic motor alone and the electric motor can be prevented from becoming incapable of generating torque due to a factor like the low energy state or the overcharged state of the electricity storage device. In normal operation, energy saving can be achieved by the hydraulic/electric combined swing mode.

MODE FOR CARRYING OUT THE INVENTION

In the following, embodiments of the present invention will be described by taking a hydraulic shovel as an example of a construction machine. The present invention is applicable generally to various construction machines (e.g., operating machines) having a swing structure, and thus the application of the present invention is not restricted to hydraulic shovels. For example, the present invention is applicable also to other construction machines such as crane vehicles having a swing structure.

First Embodiment

Figure 1:
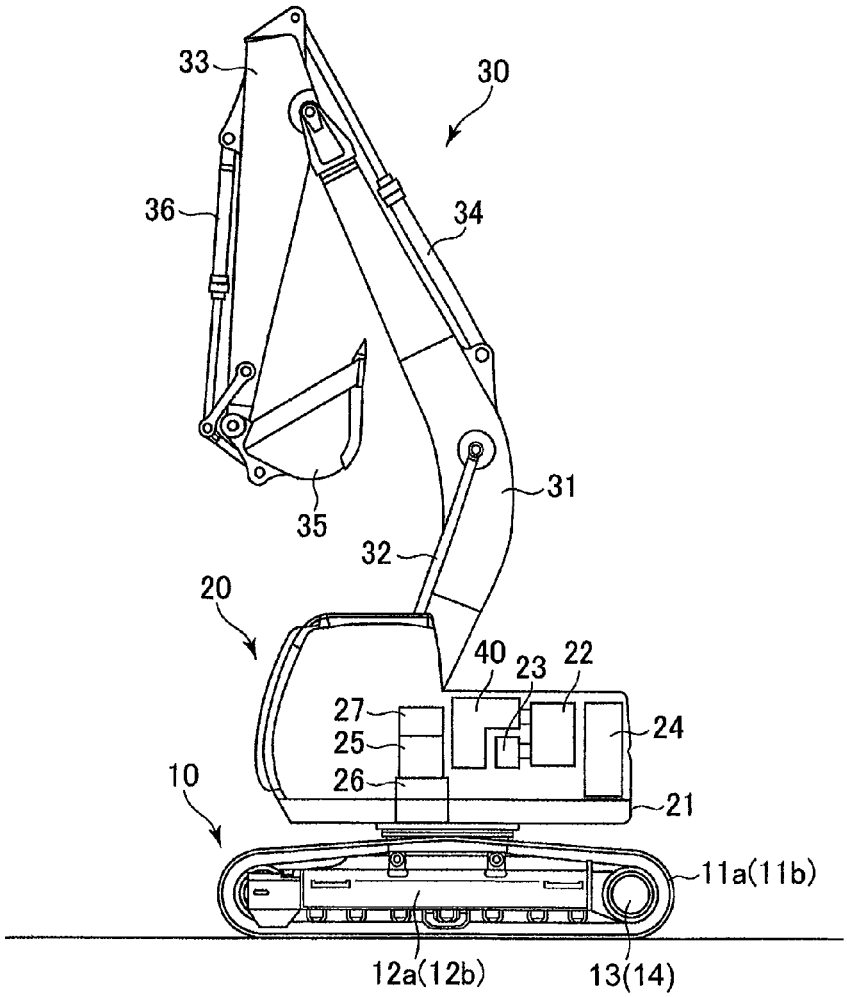
FIG. 1 is a side view of a hybrid hydraulic shovel in accordance with a first embodiment of the present invention.

FIG. 1 is a side view of a hybrid hydraulic shovel in accordance with a first embodiment of the present invention.

Referring to FIG. 1, the hybrid hydraulic shovel comprises a lower travel structure 10, an upper swing structure 20 and a shovel device 30.

The lower travel structure 10 includes a pair of crawlers 11*a* and 11*b* (only one side is shown in FIG. 1), a pair of crawler frames 12*a* and 12*b* (only one side is shown in FIG. 1), a pair of travel hydraulic motors 13 and 14 for independently driving and controlling the crawlers 11*a* and 11*b*, respectively, deceleration devices for the travel hydraulic motors 13 and 14, etc.

The upper swing structure 20 includes a swing frame 21, an engine 22 (as a prime mover) mounted on the swing frame 21, an assistant power generation motor 23 driven by the engine 22, a swing electric motor 25, a swing hydraulic motor 27, an electric double layer capacitor 24 connected to the assistant power generation motor 23 and the swing electric motor 25, a deceleration device 26 for decelerating the rotations of the swing electric motor 25 and the swing hydraulic motor 27, etc. The driving force of the swing electric motor 25 and the swing hydraulic motor 27 is transmitted via the deceleration device 26, by which the upper swing structure 20 (swing frame 21) is driven and rotated with respect to the lower travel structure 10.

The upper swing structure 20 is equipped with the shovel device (front implement) 30. The shovel device 30 includes a boom 31, a boom cylinder 32 for driving the boom 31, an arm 33 supported by a distal end part of the boom 31 to be rotatable around an axis, an arm cylinder 34 for driving the arm 33, a bucket 35 supported by the distal end of the arm 33 to be rotatable around an axis, a bucket cylinder 36 for driving the bucket 35, etc.

Further, a hydraulic system 40 for driving hydraulic actuators (such as the aforementioned travel hydraulic motors 13 and 14, swing hydraulic motor 27, boom cylinder 32, arm cylinder 34 and bucket cylinder 36) is mounted on the swing frame 21 of the upper swing structure 20. The hydraulic system 40 includes a hydraulic pump 41 (see FIG. 2) as a hydraulic pressure source for generating the hydraulic pressure and a control valve 42 (see FIG. 2) for driving and controlling the actuators. The hydraulic pump 41 is driven by the engine 22.

Figure 2:
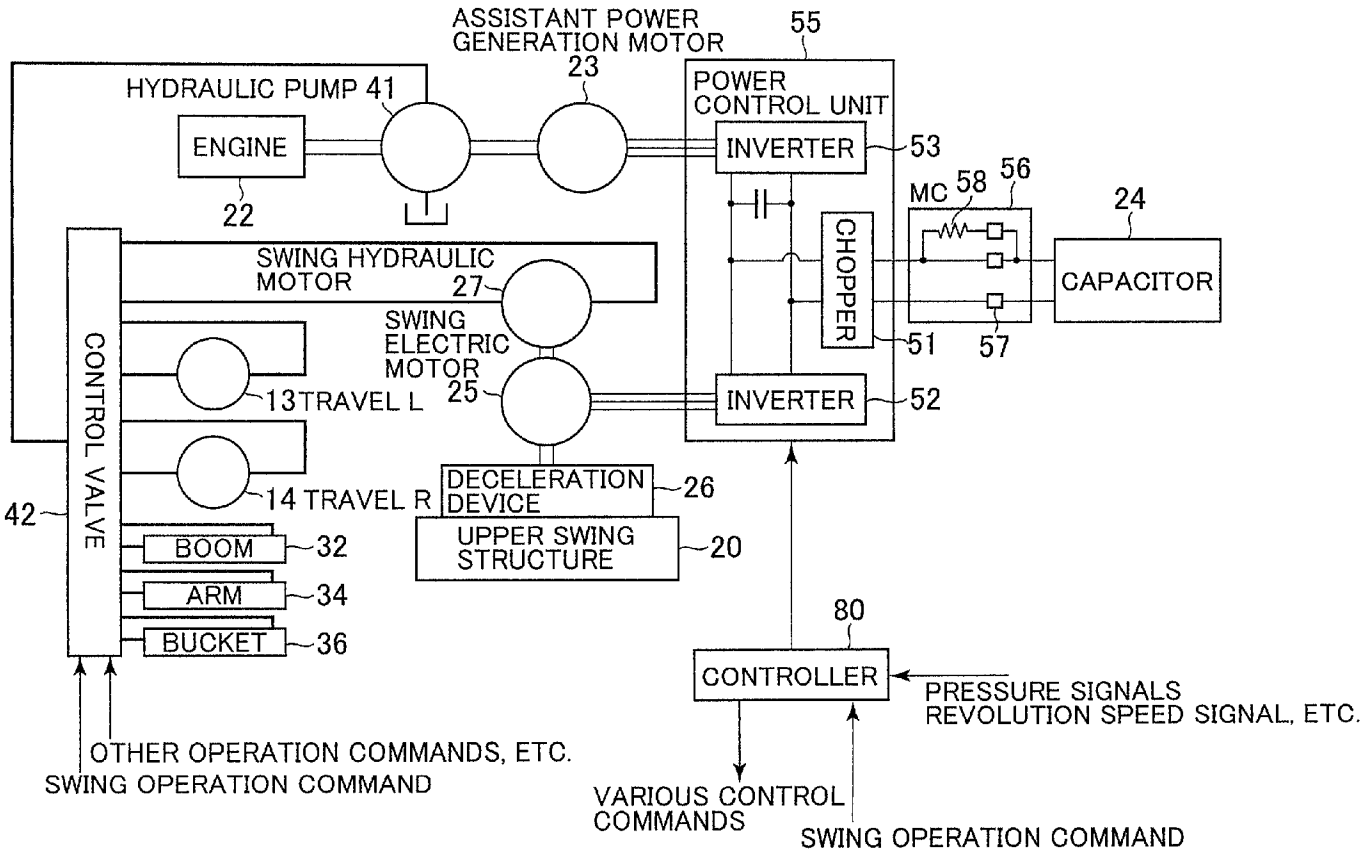
FIG. 2 is a schematic block diagram showing the system configuration of principal electric/hydraulic devices of the hybrid hydraulic shovel in accordance with the first embodiment of the present invention.

FIG. 2 shows the system configuration of principal electric/hydraulic devices of the hydraulic shovel. As shown in FIG. 2, the driving force of the engine 22 is transmitted to the hydraulic pump 41. The control valve 42 controls the flow rate and the direction of the hydraulic fluid supplied to the swing hydraulic motor 27 according to a swing operation command (hydraulic pilot signal) inputted from a control lever device 72 for the swinging (see FIG. 3). The control valve 42 also controls the flow rate and the direction of the hydraulic fluid supplied to each of the boom cylinder 32, the arm cylinder 34, the bucket cylinder 36 and the travel hydraulic motors 13 and 14 according to an operation command (hydraulic pilot signal) inputted from a control lever device 73 for operations other than the swinging (see FIG. 3).

An electric system for the hybrid hydraulic shovel is made up of the assistant power generation motor 23, the capacitor 24, the swing electric motor 25, a power control unit 55, a main contactor 56, etc. The power control unit 55 includes a chopper 51, inverters 52 and 53, a smoothing capacitor 54, etc. The main contactor 56 includes a main relay 57, an inrush current prevention circuit 58, etc.

The voltage of DC power supplied from the capacitor 24 is boosted by the chopper 51 to a prescribed bus line voltage and is inputted to the inverter 52 (for driving the swing electric motor 25) and the inverter 53 (for driving the assistant power generation motor 23). The smoothing capacitor 54 is used for stabilizing the bus line voltage. The swing electric motor 25 and the swing hydraulic motor 27, whose rotating shafts are connected to each other, cooperatively drive the upper swing structure 20 via the deceleration device 26. The capacitor 24 is charged or discharged depending on the driving status (regenerating or power running) of the assistant power generation motor 23 and the swing electric motor 25.

A controller 80 generates control commands for the control valve 42 and the power control unit 55 using the swing operation command signal, pressure signals, a revolution speed signal, etc. (explained later) and executes a variety of controls, such as switching between a hydraulic solo swing mode and a hydraulic/electric combined swing mode, swing control in each mode, abnormality monitoring of the electric system and energy management.

Figure 3:
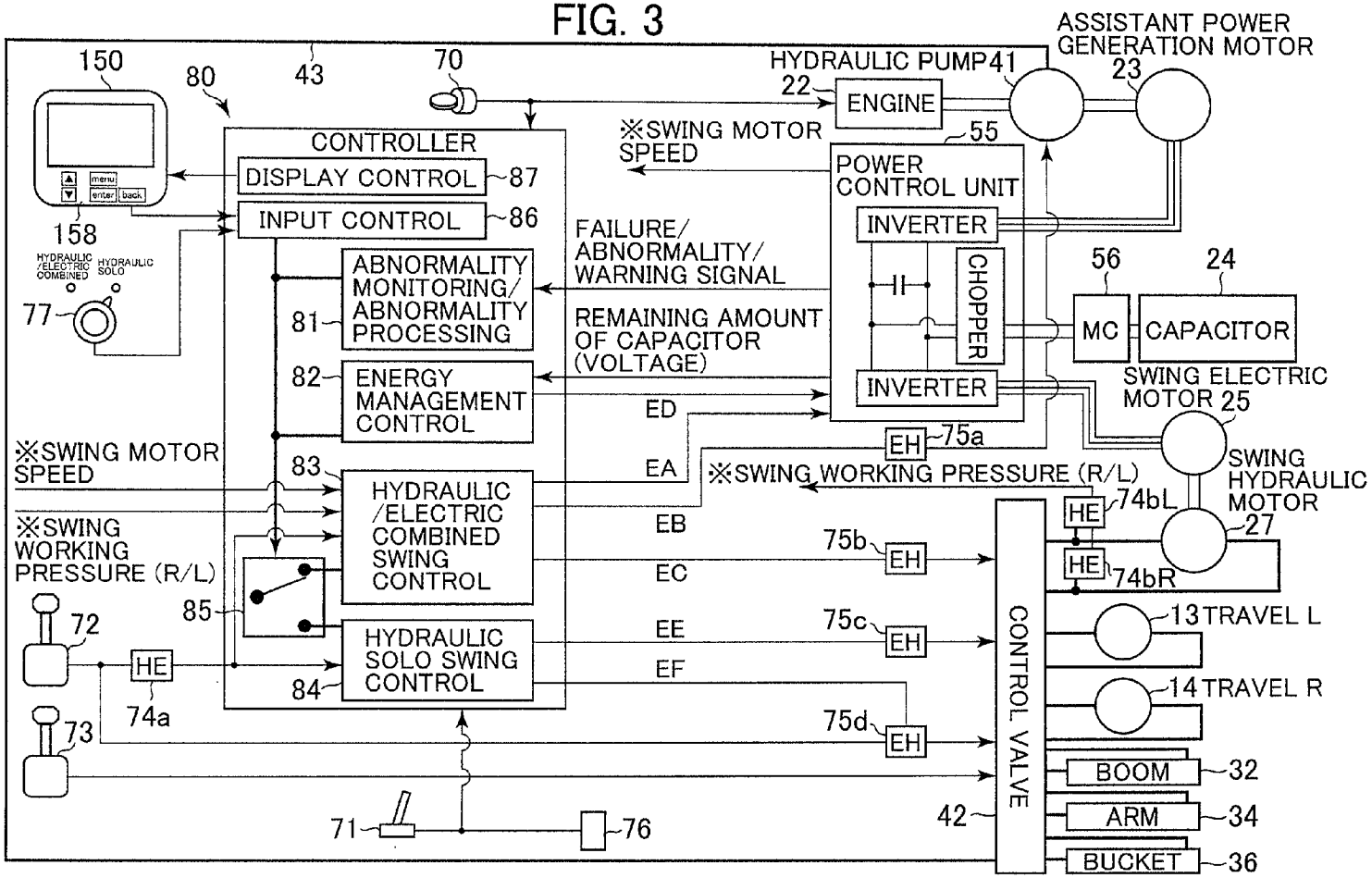
FIG. 3 is a block diagram showing the system configuration and control blocks of the hybrid hydraulic shovel in accordance with the first embodiment of the present invention.

FIG. 3 is a block diagram showing the system configuration and control blocks of the hydraulic shovel. While the system configuration of the electric/hydraulic devices shown in FIG. 3 is basically identical with that in FIG. 2, devices, control means, control signals, etc. necessary for carrying out the swing control in accordance with the present invention are shown in detail in FIG. 3.

The hydraulic shovel is equipped with an ignition key 70 for starting up the engine 22 and a gate lock lever device 71 for turning a pilot pressure shutoff valve 76 on and thereby disabling the operation of the hydraulic system when the operator stops the operation (work). The hydraulic shovel is further equipped with the aforementioned controller 80 and devices (hydraulic-electric conversion units 74*a*, 74*b*R and 74*b*L, electric-hydraulic conversion units 75*a*, 75*b*, 75*c* and 75*d* and a swing-mode selector switch 77) related to the input/output of the controller 80. These components constitute a swing control system. The hydraulic-electric conversion units 74*a*, 74*b*R and 74*b*L are implemented by pressure sensors, for example. The electric-hydraulic conversion units 75*a*, 75*b*, 75*c* and 75*d* are implemented by solenoid-operated proportional pressure-reducing valves, for example.

The controller 80 includes an abnormality monitoring/abnormality processing control block 81, an energy management control block 82, a hydraulic/electric combined swing control block 83, a hydraulic solo swing control block 84, a control switching block 85, an input control block 86, a display control block 87, etc.

In normal operation, in a state in which the whole system has no abnormality and the driving of the swing electric motor 25 is possible, the controller 80 selects the hydraulic/electric combined swing mode. In this case, the control switching block 85 has selected the hydraulic/electric combined swing control block 83, and thus the operation of the swing actuator is controlled by the hydraulic/electric combined swing control block 83. The hydraulic pilot signal generated according to the operator's input to the swing control lever device 72 is converted by the hydraulic-electric conversion unit 74*a* into an electric signal and inputted to the hydraulic/electric combined swing control block 83. Operating pressures of the swing hydraulic motor 27 are converted by the hydraulic-electric conversion units 74*b*R and 74*b*L into electric signals and inputted to the hydraulic/electric combined swing control block 83. A swing motor speed signal which is outputted by an inverter (for driving the electric motor) inside the power control unit 55 is also inputted to the hydraulic/electric combined swing control block 83.

The hydraulic/electric combined swing control block 83 calculates command torque for the swing electric motor 25 by performing prescribed calculations based on the hydraulic pilot signal from the swing control lever device 72, the operating pressure signals of the swing hydraulic motor 27 and the swing motor speed signal, and outputs a torque command EA to the power control unit 55. At the same time, the hydraulic/electric combined swing control block 83 outputs reduced torque commands EB and EC, for reducing the output torque of the hydraulic pump 41 and the output torque of the swing hydraulic motor 27 by the torque outputted by the electric motor 25, to the electric-hydraulic conversion units 75*a* and 75*b*.

Meanwhile, the hydraulic pilot signal generated according to the operator's input to the swing control lever device 72 is inputted also to the control valve 42, by which a spool 61 (see FIG. 4) for the swing motor is switched from its neutral position, the hydraulic fluid discharged from the hydraulic pump 41 is supplied to the swing hydraulic motor 27, and consequently, the swing hydraulic motor 27 is also driven at the same time.

The amount of electricity stored in the capacitor 24 (electric amount) increases/decreases depending on the difference between the energy consumed by the electric motor 25 in acceleration and the energy regenerated by the electric motor 25 in deceleration. This is controlled by the energy management control block 82. The energy management control block 82 performs the control so as to keep the electric amount of the capacitor 24 within a prescribed range by outputting a power generation/assistance command ED to the assistant power generation motor 23.

When a failure, an abnormality or a warning state has occurred in the electric system (the power control unit 55, the electric motor 25, the capacitor 24, etc.), when the electric amount of the capacitor 24 has gone out of the prescribed range, or when a switching command is inputted from the swing-mode selector switch 77, the abnormality monitoring/abnormality processing control block 81, the energy management control block 82 or the input control block 86 switches the control switching block 85 to make it select the hydraulic solo swing control block 84, by which the swing mode is switched from the hydraulic/electric combined swing mode to the hydraulic solo swing mode. Basically, the swing hydraulic system has been properly matched with the swing electric motor 25 so as to operate in coordination with the electric motor 25. Thus, the hydraulic solo swing control block 84 executes the control so that the swing operability is not impaired even without the torque of the electric motor 25, by making a correction of increasing the drive torque of the hydraulic motor 27 and a correction of increasing the braking torque of the hydraulic motor 27 by outputting a swing drive property correction command EE and a swing pilot pressure correction command EF to the electric-hydraulic conversion units 75*c* and 75*d*, respectively.

Figure 4:
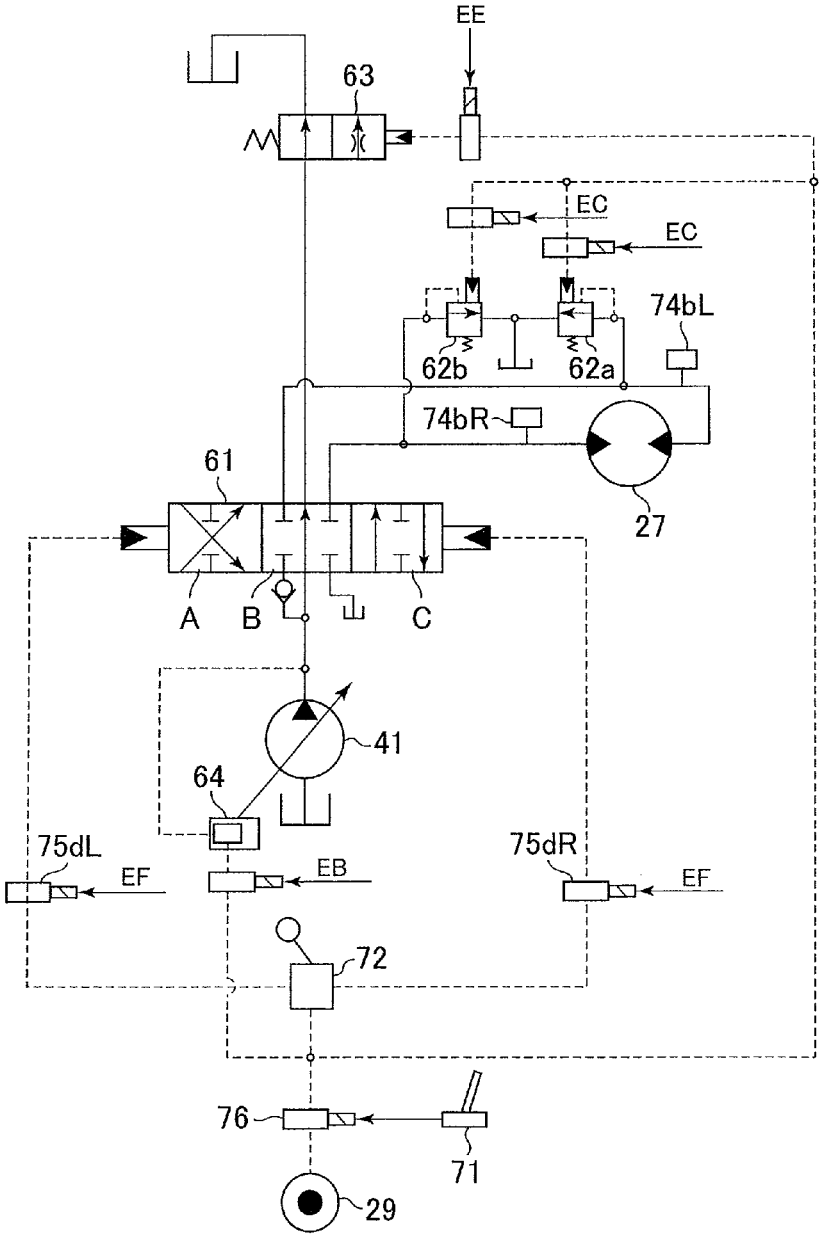
FIG. 4 is a schematic diagram showing the configuration of a swing hydraulic system in the first embodiment of the present invention.

FIG. 4 shows the details of the swing hydraulic system, wherein elements identical with those in FIG. 3 are indicated with the same reference characters as in FIG. 3. The control valve 42 shown in FIG. 3 has a valve component called "spool" for each actuator. In response to a command (hydraulic pilot signal) from the control lever device 72 or 73, a corresponding spool shifts so as to change an opening area, by which the flow rate of the hydraulic fluid passing through each hydraulic line changes. The swing hydraulic system shown in FIG. 4 includes only a swing spool (spool for the swinging).

The swing hydraulic system can be switched between a first mode in which the maximum output torque of the swing hydraulic motor 27 is set at first torque and a second mode in which the maximum output torque of the swing hydraulic motor 27 is set at second torque higher than the first torque. The details of the switching will be explained below.

Referring to FIG. 4, the swing hydraulic system includes the hydraulic pump 41, the swing hydraulic motor 27, the swing spool 61, variable overload relief valves 62*a* and 62*b* for the swinging, and a center bypass cut valve 63 as a swing auxiliary valve.

The hydraulic pump 41 is a variable displacement pump. The hydraulic pump 41 is equipped with a regulator 64 including a torque control unit 64*a*. By the operation of the regulator 64, the tilting angle of the hydraulic pump 41 is changed, the displacement (capacity) of the hydraulic pump 41 is changed, and consequently, the discharge flow rate and the output torque of the hydraulic pump 41 are changed. When the reduced torque command EB is outputted by the hydraulic/electric combined swing control block 83 (see FIG. 3) to the electric-hydraulic conversion unit 75*a*, the electric-hydraulic conversion unit 75*a* outputs corresponding control pressure to the torque control unit 64*a* of the regulator 64. Accordingly, the torque control unit 64*a* changes its setting so as to reduce the maximum output torque of the hydraulic pump 41 by the torque outputted by the electric motor 25.

Figure 5:
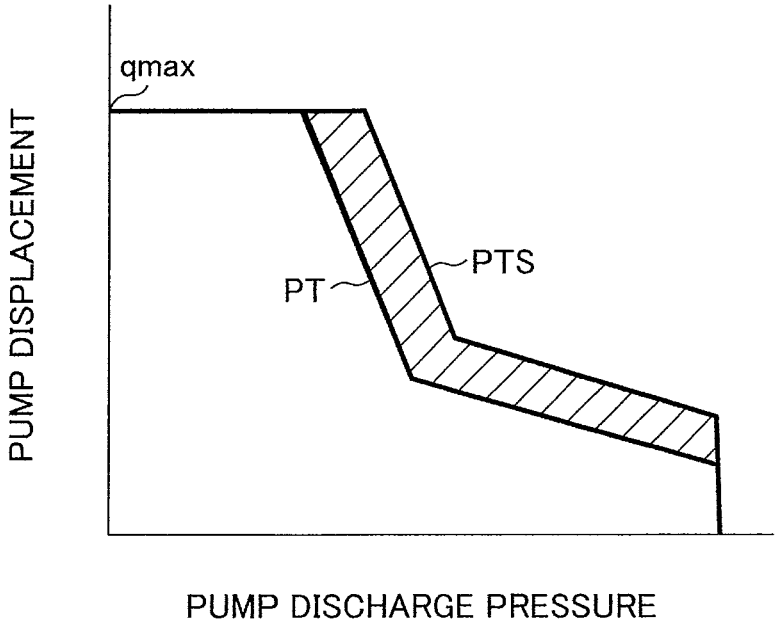
FIG. 5 is a graph showing the torque control characteristics of a hydraulic pump in the first embodiment of the present invention.

FIG. 5 is a graph showing the torque control characteristics of the hydraulic pump 41, wherein the horizontal axis represents the discharge pressure of the hydraulic pump 41 and the vertical axis represents the displacement of the hydraulic pump 41.

When the hydraulic/electric combined swing mode has been selected and the reduced torque command EB is being outputted to the electric-hydraulic conversion unit 75*a*, the electric-hydraulic conversion unit 75*a* is generating the control pressure. In this case, the setting of the torque control unit 64*a* has the characteristics of the solid line PT where the maximum output torque has decreased from that represented by the solid line PTS (first mode).

When the hydraulic solo swing mode has been selected and the reduced torque command EB is not being outputted to the electric-hydraulic conversion unit 75*a*, the torque control unit 64*a* changes to the characteristics of the solid line PTS (second mode), by which the maximum output torque of the hydraulic pump 41 is increased by the area of the hatching.

Returning to FIG. 4, the swing spool 61 has three positions A, B and C. In response to the swing operation command (hydraulic pilot signal) from the control lever device 72, the swing spool 61 is switched continuously from the neutral position B to the position A or C.

The control lever device 72 includes a pressure-reducing valve which reduces the pressure supplied from a pilot hydraulic pressure source 29 by an amount corresponding to the operation amount of the lever. The control lever device 72 supplies pressure corresponding to the lever operation amount (hydraulic pilot signal) to a right pressure chamber or a left pressure chamber of the swing spool 61.

When the swing spool 61 is at the neutral position B, the hydraulic fluid discharged from the hydraulic pump 41 passes through a bleed-off aperture and the center bypass cut valve 63 and returns to the tank.

When the swing spool 61 receiving the pressure corresponding to the lever operation amount (hydraulic pilot signal) is switched to the position A, the hydraulic fluid from the hydraulic pump 41 is sent to the right side of the swing hydraulic motor 27 via a meter-in aperture at the position A. The hydraulic fluid that returns from the swing hydraulic motor 27 returns to the tank via a meter-out aperture at the position A. Consequently, the swing hydraulic motor 27 rotates in a direction.

Conversely, when the swing spool 61 receiving the pressure corresponding to the lever operation amount (hydraulic pilot signal) is switched to the position C, the hydraulic fluid from the hydraulic pump 41 is sent to the left side of the swing hydraulic motor 27 via a meter-in aperture at the position C. The hydraulic fluid that returns from the swing hydraulic motor 27 returns to the tank via a meter-out aperture at the position C. Consequently, the swing hydraulic motor 27 rotates in a direction opposite to the case of the position A.

When the swing spool 61 is situated at an intermediate position between the position B and the position A, the hydraulic fluid from the hydraulic pump 41 is distributed to the bleed-off aperture and the meter-in aperture. In this case, pressure corresponding to the opening area of the bleed-off aperture and the opening area of the center bypass cut valve 63 develops on the inlet side of the meter-in aperture. By the pressure, the hydraulic fluid is supplied to the swing hydraulic motor 27 and operating torque corresponding to the pressure (opening area of the bleed-off aperture) is applied to the swing hydraulic motor 27. The hydraulic fluid discharged from the swing hydraulic motor 27 receives resistance corresponding to the opening area of the meter-out aperture at that time (back pressure), by which braking torque corresponding to the opening area of the meter-out aperture is generated. The same goes for cases where the swing spool 61 is situated at an intermediate position between the position B and the position C.

When the control lever of the control lever device 72 is returned to its neutral position and the swing spool 61 is returned to the neutral position B, the swing hydraulic motor 27 tends to keep on rotating due to the inertia of the upper swing structure 20 (inertial body). In this case, when the pressure of the hydraulic fluid discharged from the swing hydraulic motor 27 (back pressure) is about to exceed a preset pressure of the variable overload relief valve 62*a* or 62*b* for the swinging, the overload relief valve 62*a* or 62*b* operates to drain part of the hydraulic fluid into the tank, by which the increase in the back pressure is restricted. Consequently, braking torque corresponding to the preset pressure of the overload relief valve 62*a* or 62*b* is generated.

Figure 6A:
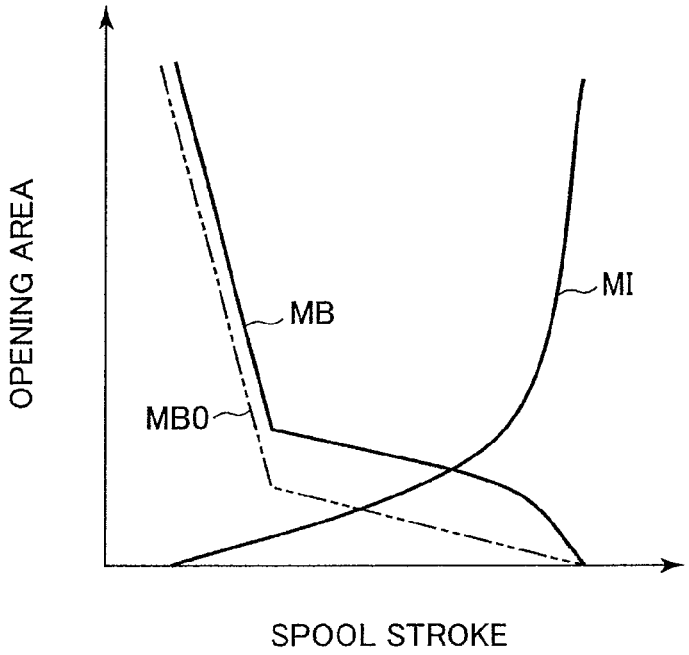
FIG. 6A is a graph showing a meter-in opening area characteristic and a bleed-off opening area characteristic of a swing spool in the first embodiment of the present invention.
Figure 6B:
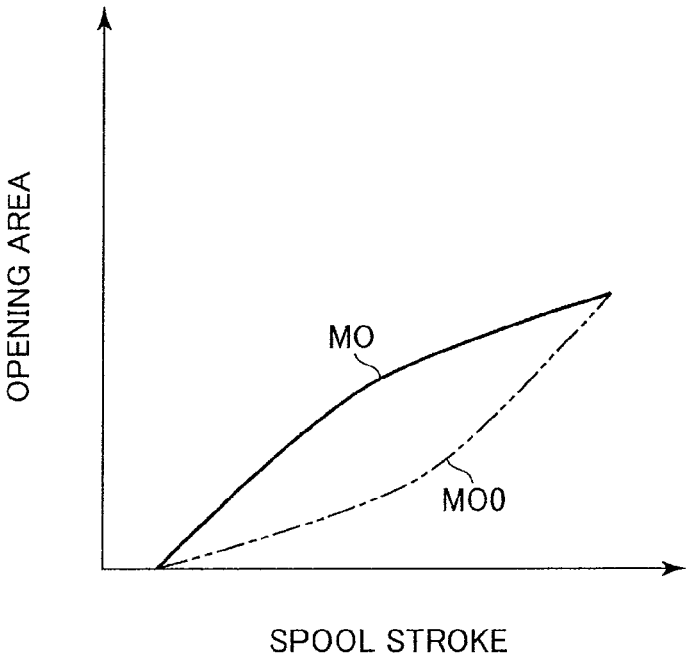
FIG. 6B is a graph showing a meter-out opening area characteristic of the swing spool in the first embodiment of the present invention.

FIG. 6A is a graph showing the meter-in opening area characteristic and the bleed-off opening area characteristic of the swing spool 61 in the first embodiment of the present invention. FIG. 6B is a graph showing the meter-out opening area characteristic of the swing spool 61 in the first embodiment of the present invention.

In FIG. 6A, the solid line MI indicates the meter-in opening area characteristic in this embodiment and the solid line MB indicates the bleed-off opening area characteristic in this embodiment. The two-dot chain line MBO indicates a bleed-off opening area characteristic with which satisfactory operability can be secured in a conventional hydraulic shovel employing no electric motor. The bleed-off opening area characteristic MB in this embodiment is designed so that the opening areas at the starting point and the end point of the control zone coincide with those in the conventional characteristic but the opening areas in the intermediate zone (between the starting point and the end point) are larger than those in the conventional characteristic.

In FIG. 6B, the solid line MO indicates the meter-out opening area characteristic in this embodiment and the two-dot chain line MOO indicates a meter-out opening area characteristic with which satisfactory operability can be secured in the conventional hydraulic shovel employing no electric motor. The meter-out opening area characteristic MO in this embodiment is designed so that the opening areas at the starting point and the end point of the control zone coincide with those in the conventional characteristic but the opening areas in the intermediate zone are larger than those in the conventional characteristic.

Figure 7:
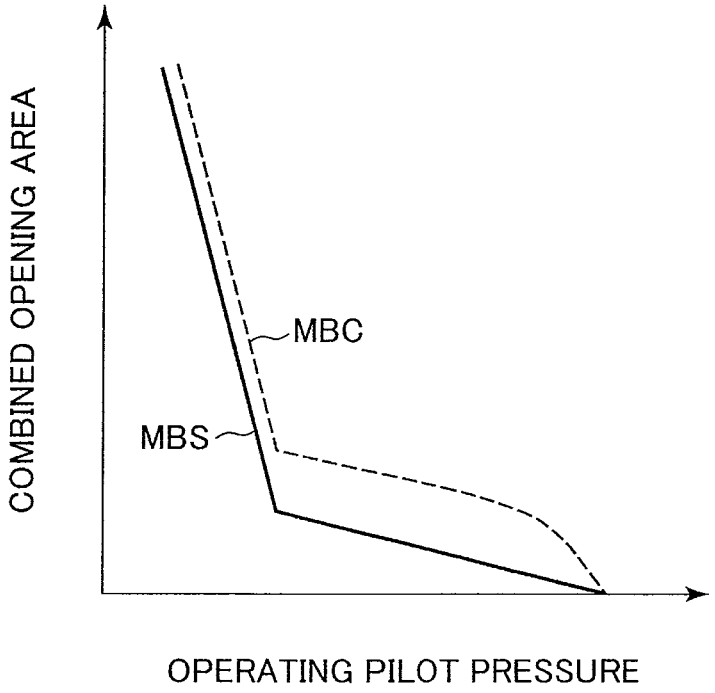
FIG. 7 is a graph showing a combined opening area characteristic of a meter-in aperture of a swing spool and a center bypass cut valve with respect to a hydraulic pilot signal (operating pilot pressure) in the first embodiment of the present invention.

FIG. 7 is a graph showing a combined opening area characteristic of the meter-in aperture of the swing spool 61 and the center bypass cut valve 63 with respect to the hydraulic pilot signal (operating pilot pressure).

When the hydraulic/electric combined swing mode has been selected, the swing drive property correction command EE is not outputted and thus the center bypass cut valve 63 is at the open position shown in FIG. 4. Therefore, the combined opening area characteristic of the meter-in aperture of the swing spool 61 and the center bypass cut valve 63 is the characteristic indicated by the dotted line MBC which is determined exclusively by the bleed-off opening area characteristic MB shown in FIG. 6A (first mode).

When the hydraulic solo swing mode is selected, the swing drive property correction command EE is outputted to the electric-hydraulic conversion unit 75*c* as mentioned above. The electric-hydraulic conversion unit 75*c* outputs corresponding control pressure to a pressure receiving part of the center bypass cut valve 63, by which the center bypass cut valve 63 is switched to an aperture position (to the right of the open position in FIG. 4). By the switching of the center bypass cut valve 63, the combined opening area characteristic of the meter-in aperture of the swing spool 61 and the center bypass cut valve 63 with respect to the hydraulic pilot signal is changed to the characteristic of the solid line MBS where the combined opening area is smaller than that in the characteristic of the dotted line MBC (second mode). This combined opening area characteristic of the solid line MBS has been designed to be equivalent to the bleed-off opening area characteristic MBO capable of securing satisfactory operability in the conventional hydraulic shovel.

Figure 8:
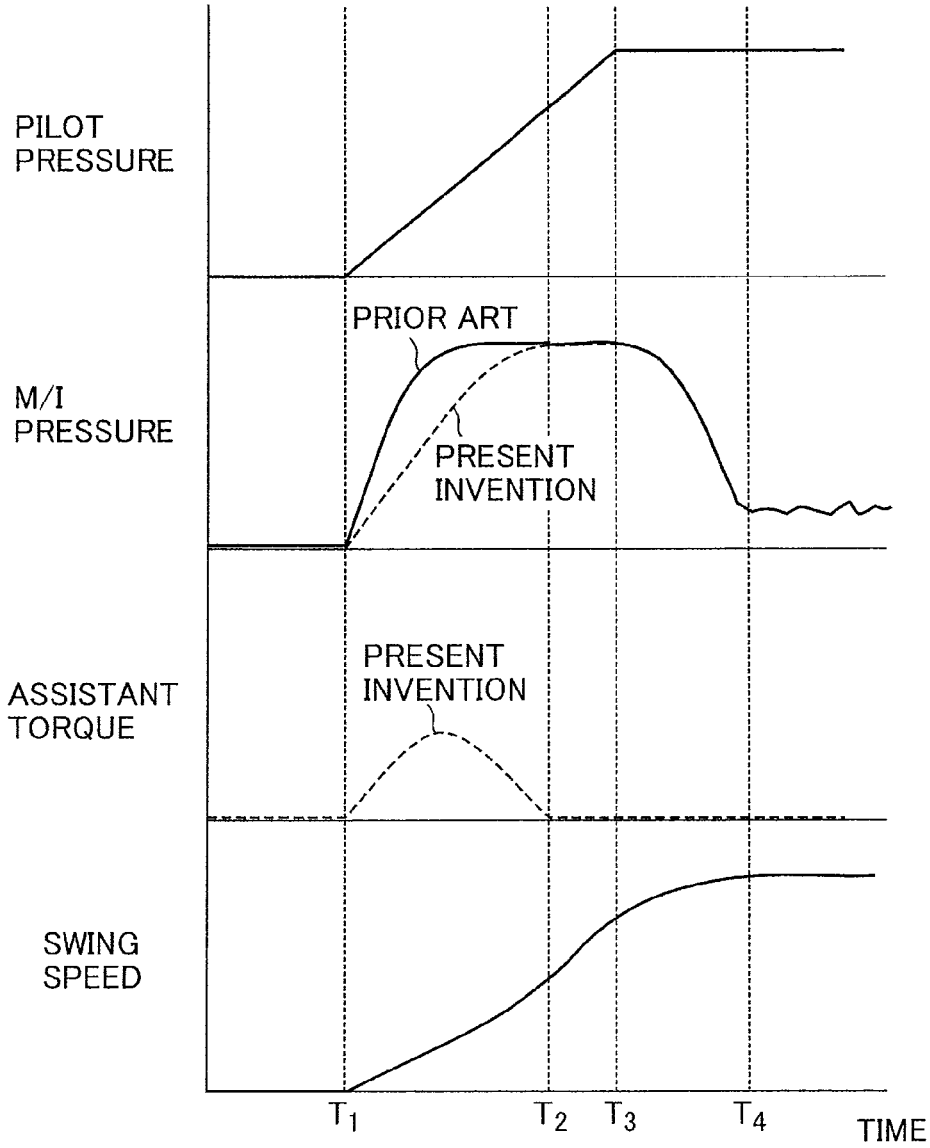
FIG. 8 is a graph showing time-line waveforms of the hydraulic pilot signal (pilot pressure), meter-in pressure (M/I pressure), assistant torque of a swing electric motor and revolution speed (swing speed) of an upper swing structure in a swing driving operation in a hydraulic/electric combined swing mode in the first embodiment of the present invention.

FIG. 8 is a graph showing time-line waveforms of the hydraulic pilot signal (pilot pressure), the meter-in pressure (M/I pressure), the assistant torque of the swing electric motor 25 and the revolution speed (swing speed) of the upper swing structure 20 in the swing driving operation in the hydraulic/electric combined swing mode. From a swing-stopped state in which the pilot pressure equals 0, the hydraulic pilot signal (pilot pressure) was increased with time (T=T1−T4) like a Ramp function (P(T)=0: T<T1, P(T)=AT: T1≤T≤T3, P(T)=Pmax: T>T3) up to the maximum pilot pressure.

When the hydraulic/electric combined swing mode has been selected, the combined opening area characteristic of the meter-in aperture of the swing spool 61 and the center bypass cut valve 63 is determined exclusively by the bleed-off opening area characteristic MB shown in FIG. 6A as indicated by the dotted line MBC in FIG. 7. Thus, the meter-in pressure (M/I pressure) in this embodiment becomes lower than that in the conventional hydraulic shovel due to the larger opening area of the bleed-off aperture. Since the meter-in pressure corresponds to the operating torque (acceleration torque) of the swing hydraulic motor 27, acceleration torque compensating for the decrease in the meter-in pressure has to be provided by the electric motor 25. In FIG. 8, the positive assistant torque means assistant torque on the power running side. In this embodiment, the control is executed so that the total sum of the assistant torque of the electric motor 25 and the acceleration torque deriving from the meter-in pressure caused by the swing spool 61 substantially equals the acceleration torque generated in the conventional hydraulic shovel. By this control, the swing speed of the upper swing structure 20 is allowed to give an acceleration feeling equivalent to that in the conventional hydraulic shovel.

In contrast, when the hydraulic solo swing mode is selected, the combined opening area characteristic of the meter-in aperture of the swing spool 61 and the center bypass cut valve 63 is changed to the characteristic of the solid line MBS since the combined opening area is smaller than that in the characteristic of the dotted line MBC shown in FIG. 7. Thus, the meter-in pressure caused by the swing spool 61 increases to the meter-in pressure acquired in the conventional hydraulic shovel (solid line in FIG. 8) and the control is executed so that the acceleration torque deriving from the meter-in pressure caused by the swing spool 61 substantially equals the acceleration torque generated in the conventional hydraulic shovel. By this control, the swing speed of the upper swing structure 20 is allowed to give an acceleration feeling equivalent to that in the conventional hydraulic shovel.

The fact that the upper swing structure 20 can be swung (rotated) by the hydraulic motor 27 alone means that the maximum output torque of the swing hydraulic motor 27 is higher than that of the swing electric motor 25. This means that even if the electric motor 25 happens to operate in an unexpected way in the hydraulic/electric combined swing mode, the trouble does not lead to any substantially dangerous movement as long as the hydraulic circuit is operating normally. Thus, the present invention is advantageous in terms of safety as well.

Figure 9:
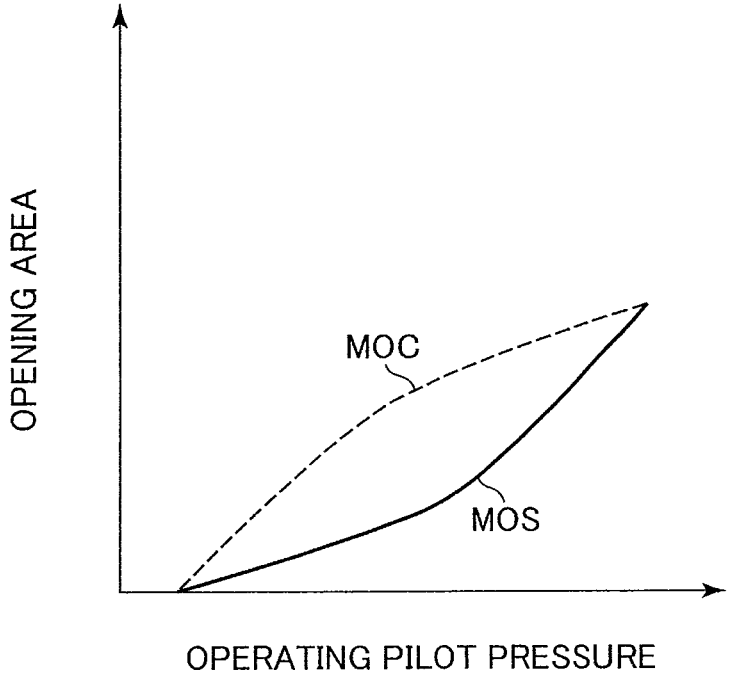
FIG. 9 is a graph showing a meter-out opening area characteristic of the swing spool with respect to the hydraulic pilot signal (operating pilot pressure) in the first embodiment of the present invention.

FIG. 9 is a graph showing a meter-out opening area characteristic of the swing spool 61 with respect to the hydraulic pilot signal (operating pilot pressure).

When the hydraulic/electric combined swing mode has been selected, the swing pilot pressure correction command EF is not outputted. Thus, the center bypass cut valve 63 is at the open position shown in FIG. 4 and the meter-out opening area characteristic of the swing spool 61 is indicated by the dotted line MOC which exhibits variation similar to that of the meter-out opening area characteristic MO shown in FIG. 6B (first mode).

When the hydraulic solo swing mode is selected, the swing pilot pressure correction command EF is outputted to the electric-hydraulic conversion unit 75*d* shown in FIG. 3 (electric-hydraulic conversion units 75*d*R and 75*d*L shown in FIG. 4) as mentioned above. The electric-hydraulic conversion unit 75*d* corrects (reduces) the hydraulic pilot signal (operating pilot pressure) generated by the control lever device 72. By the correction of the hydraulic pilot signal, the meter-out opening area characteristic of the swing spool 61 with respect to the hydraulic pilot signal is changed to the characteristic of the solid line MOS where the opening area in the intermediate zone is smaller than that in the characteristic of the dotted line MOC shown in FIG. 10 (second mode). This opening area characteristic of the solid line MOS has been designed to be equivalent to the meter-out opening area characteristic MOO capable of securing satisfactory operability in the conventional hydraulic shovel.

Figure 10:
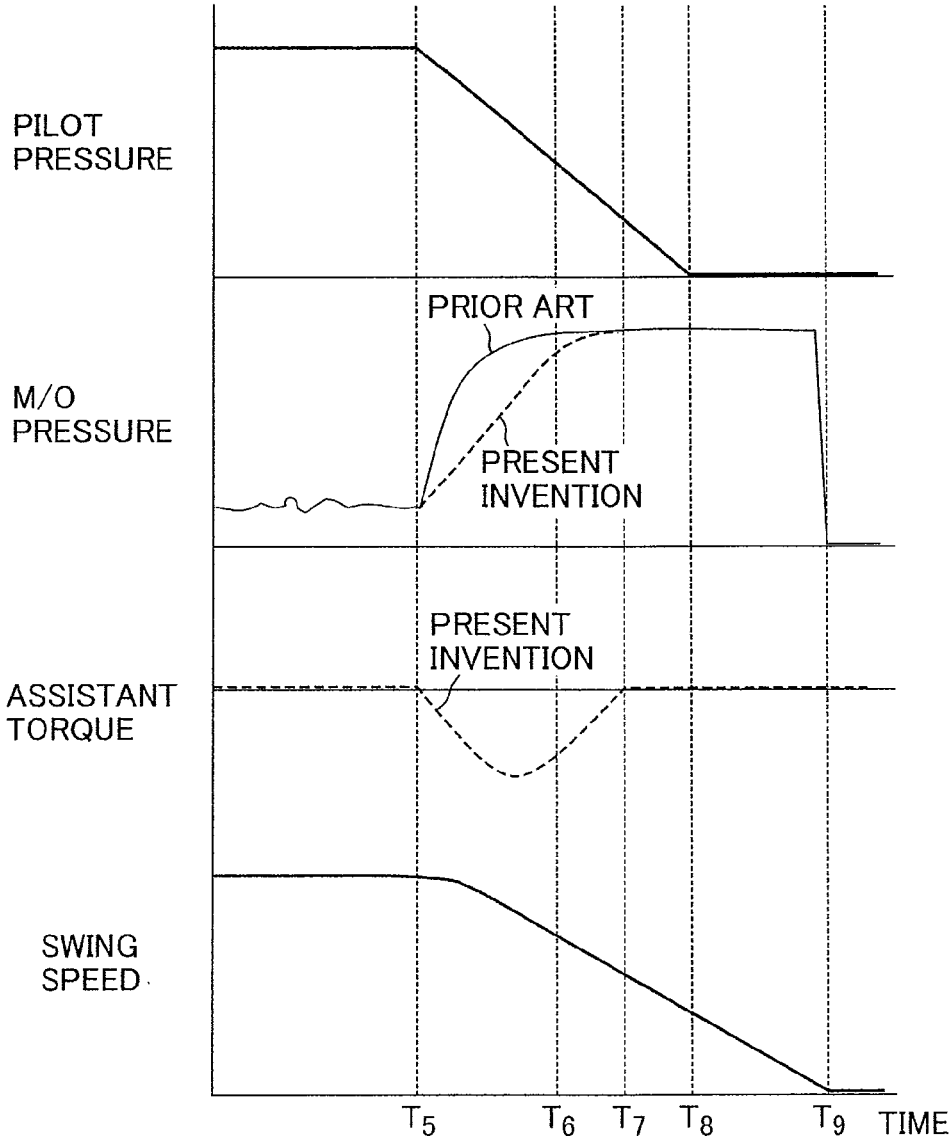
FIG. 10 is a graph showing time-line waveforms of the hydraulic pilot signal (pilot pressure), meter-out pressure (M/O pressure), the assistant torque of the swing electric motor and the revolution speed (swing speed) of the upper swing structure in a swing braking/stopping operation in the hydraulic/electric combined swing mode in the first embodiment of the present invention.

FIG. 10 is a graph showing time-line waveforms of the hydraulic pilot signal (pilot pressure), the meter-out pressure (M/O pressure), the assistant torque of the swing electric motor 25 and the revolution speed (swing speed) of the upper swing structure 20 in a swing braking/stopping operation in the hydraulic/electric combined swing mode. From the maximum swing speed with the maximum pilot pressure, the swing speed was reduced by decreasing the hydraulic pilot signal (pilot pressure) with time (T=T5−T9) like a Ramp function (P(T)=Pmax: T<T5, P(T)=−AT: T5≤T≤T8, P(T)=0: T>T8) down to 0.

When the hydraulic/electric combined swing mode has been selected, the meter-out opening area characteristic of the swing spool 61 with respect to the hydraulic pilot signal exhibits variation similar to that of the meter-out opening area characteristic MO in FIG. 6B as indicated by the dotted line MOC in FIG. 9. Thus, the meter-out pressure (M/O pressure) in this embodiment becomes lower than that in the conventional hydraulic shovel due to the larger opening area of the meter-out aperture shown in FIG. 6B. Since the meter-out pressure corresponds to the brake torque (braking torque), brake torque compensating for the decrease in the meter-out pressure has to be provided by the electric motor 25. In FIG. 10, the negative assistant torque means assistant torque on the regeneration side. In this embodiment, the control is executed so that the total sum of the assistant torque of the electric motor 25 and the brake torque deriving from the meter-out pressure caused by the swing spool 61 substantially equals the brake torque generated in the conventional hydraulic shovel. By this control, the swing speed of the upper swing structure 20 is allowed to give a deceleration feeling equivalent to that in the conventional hydraulic shovel.

In contrast, when the hydraulic solo swing mode is selected, the meter-out opening area characteristic of the swing spool 61 with respect to the hydraulic pilot signal is changed to the characteristic of the solid line MOS where the opening area in the intermediate zone is smaller than that in the characteristic of the dotted line MOC shown in FIG. 9. Thus, the meter-out pressure caused by the swing spool 61 increases to the meter-out pressure acquired in the conventional hydraulic shovel (solid line in FIG. 10) and the control is executed so that the brake torque deriving from the meter-out pressure caused by the swing spool 61 substantially equals the brake torque generated in the conventional hydraulic shovel. By this control, the swing speed of the upper swing structure 20 is allowed to give a deceleration feeling equivalent to that in the conventional hydraulic shovel.

Figure 11:
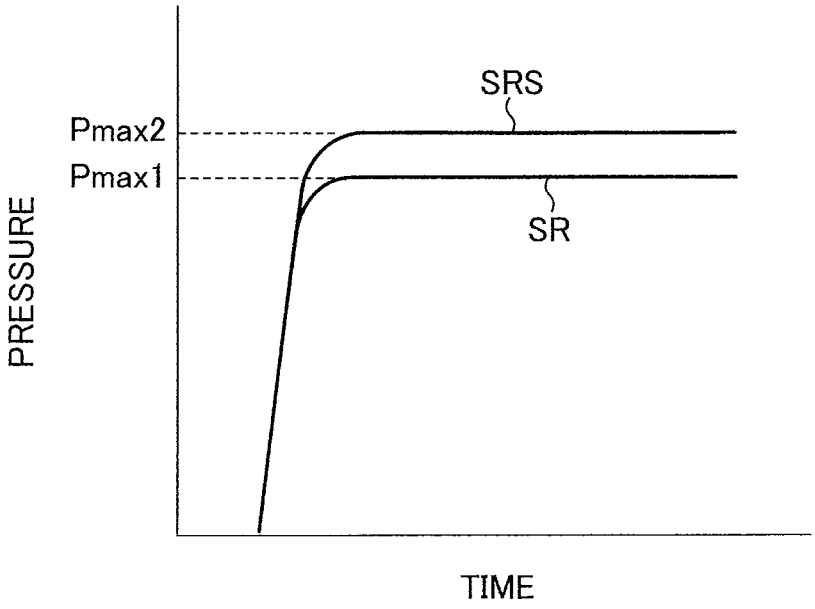
FIG. 11 is a graph showing relief pressure characteristics of variable overload relief valves for the swinging in the first embodiment of the present invention.

FIG. 11 is a graph showing relief pressure characteristics of the variable overload relief valves 62*a* and 62*b* for the swinging.

When the hydraulic/electric combined swing mode has been selected and the reduced torque command EC is being outputted to the electric-hydraulic conversion unit 75*b* shown in FIG. 3 (electric-hydraulic conversion units 75*b*R and 75*b*L shown in FIG. 4), the electric-hydraulic conversion unit 75*b* generates control pressure. The control pressure acts on one side of each variable overload relief valve 62*a*, 62*b* to reduce the preset pressure of the valve, by which the relief characteristic of each variable overload relief valve 62*a*, 62*b* is set at the characteristic of the solid line SR whose relief pressure equals Pmax1 (first mode).

When the hydraulic solo swing mode has been selected and the reduced torque command EC is not being outputted to the electric-hydraulic conversion unit 75*b* (electric-hydraulic conversion units 75*b*R and 75*b*L shown in FIG. 4), the electric-hydraulic conversion unit 75*b* does not generate the control pressure. Thus, the relief characteristic of each variable overload relief valve 62*a*, 62*b* is set at the characteristic of the solid line SRS whose relief pressure equals Pmax2 that is higher than Pmax1 (second mode). The braking torque increases corresponding to the increase in the relief pressure.

Thus, when the hydraulic/electric combined swing mode is selected, the relief pressure of each variable overload relief valve 62*a*, 62*b* is set at Pmax1 that is lower than Pmax2. When the control lever of the control lever device 72 is returned to the neutral position, the pressure of the hydraulic fluid discharged from the swing hydraulic motor 27 (back pressure) rises to Pmax1 (the lower preset pressure of each variable overload relief valve 62*a*, 62*b*) and the control is executed so that the total some of the assistant torque of the electric motor 25 and the brake torque deriving from the back pressure caused by the variable overload relief valve 62*a* or 62*b* substantially equals the brake torque generated in the conventional hydraulic shovel. By this control, the swing speed of the upper swing structure 20 is allowed to give a deceleration feeling equivalent to that in the conventional hydraulic shovel.

When the hydraulic solo swing mode is selected, the relief pressure of each variable overload relief valve 62*a*, 62*b* is set at Pmax2 higher than Pmax1. When the control lever of the control lever device 72 is returned to the neutral position, the pressure of the hydraulic fluid discharged from the swing hydraulic motor 27 (back pressure) rises to Pmax2 (the higher preset pressure of each variable overload relief valve 62*a*, 62B) and the control is executed so that the brake torque deriving from the back pressure caused by the variable overload relief valve 62*a* or 62*b* substantially equals the brake torque generated in the conventional hydraulic shovel. By this control, the swing speed of the upper swing structure 20 is allowed to give a deceleration feeling equivalent to that in the conventional hydraulic shovel.

Returning to FIG. 3, the abnormality monitoring/abnormality processing control block 81 and the energy management control block 82 of the controller 80 will be explained further. The abnormality monitoring/abnormality processing control block 81 and the energy management control block 82 operate to carry out automatic switching control.

When a failure, an abnormality or a warning state has occurred in the electric system (the power control unit 55, the electric motor 25, the capacitor 24, etc.), the abnormality monitoring/abnormality processing control block 81 outputs an error signal to the control switching block 85 while judging whether the hydraulic shovel is in an idling state or not. Based on the error signal, the control switching block 85 executes mode switching control and thereby switches the swing mode from the hydraulic/electric combined swing mode to the hydraulic solo swing mode. Incidentally, when it is judged that there exists an abnormality that can damage the system or lead to a significant failure or disaster (e.g., overcurrent abnormality in an inverter), the abnormality monitoring/abnormality processing control block 81 outputs the error signal to the control switching block 85 even during operation.

When the above abnormality has been eliminated, the abnormality monitoring/abnormality processing control block 81 outputs an error elimination signal to the control switching block 85 while judging whether the hydraulic shovel is in the idling state or not. Based on the error elimination signal, the control switching block 85 executes the mode switching control and thereby switches the swing mode from the hydraulic solo swing mode to the hydraulic/electric combined swing mode (returning operation).

As an initial setting, the energy management control block 82 sets the swing mode in the hydraulic solo swing mode by selecting the hydraulic solo swing control block 84. With this setting, even when the amount of electricity stored in the capacitor (electric amount) is insufficient at the startup of the hydraulic shovel, the operator can immediately set the hydraulic shovel in the operable state by turning the pilot pressure shutoff valve 76 OFF by shifting the gate lock lever device 71 from a LOCK position to an UNLOCK (RELEASE) position.

The energy management control block 82 executes charging/discharging control, etc. as a background process during the operation. When the driving of the swing electric motor is judged to have become possible, the energy management control block 82 outputs a preparation completion signal to the control switching block 85 while judging whether the hydraulic shovel is in the idling state or not. Based on the preparation completion signal, the control switching block 85 executes the mode switching control and thereby switches the swing mode from the hydraulic solo swing mode to the hydraulic/electric combined swing mode.

The charging/discharging control by the energy management control block 82 is executed as follows: First, the energy management control block 82 activates the power control unit 55 and executes the initial charging process for the inverters 52 and 53 and the smoothing capacitor 54 and a connection process for the main contactor 56. Subsequently, the energy management control block 82 judges whether the capacitor 24 is at specified voltage or not. When the capacitor 24 is below the specified voltage, the energy management control block 82 executes capacitor charging control. When the capacitor 24 is above the specified voltage, the energy management control block 82 executes capacitor discharging control. When the capacitor 24 is at the specified voltage, the energy management control block 82 recognizes that the preparation for the hydraulic/electric combined swing mode is complete.

A configuration specific to this embodiment will be explained further.

Referring again to FIG. 3, the swing control system further includes the swing-mode selector switch 77 and a monitor device 150 which are arranged in the cab. The controller 80 includes the input control block 86 and the display control block 87.

The input control block 86 receives the switching command signal from the swing-mode selector switch 77 and outputs the signal to the control switching block 85. The command signal from the input control block 86 (especially, the switching command signal for switching the swing mode from the hydraulic/electric combined swing mode to the hydraulic solo swing mode) is prioritized over the signals from the abnormality monitoring/abnormality processing control block 81 and the energy management control block 82. The display control block 87 outputs prescribed display information to the monitor device 150.

Figure 12A:
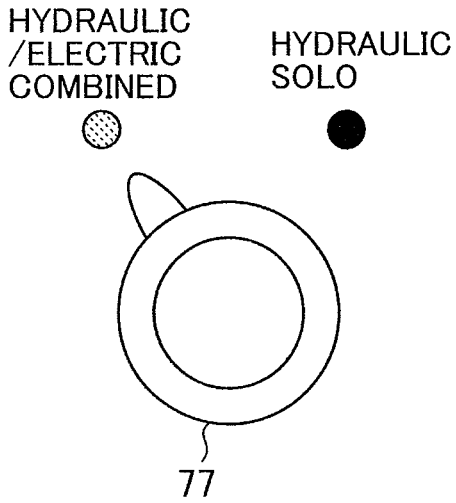
FIG. 12A is a schematic diagram showing the details of a swing-mode selector switch as a configuration specific to the first embodiment of the present invention (hydraulic/electric combined swing).
Figure 12B:
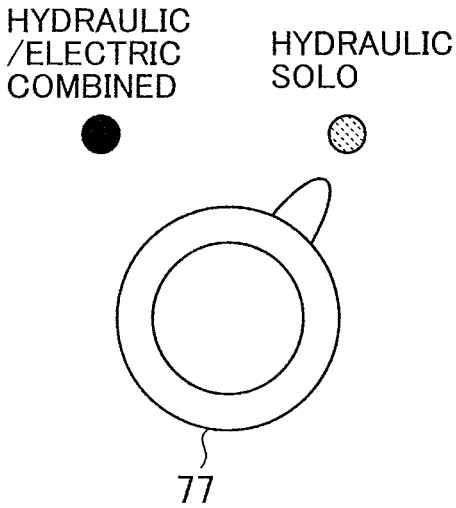
FIG. 12B is a schematic diagram showing the details of a swing-mode selector switch as a configuration specific to the first embodiment of the present invention (hydraulic solo swing).

FIG. 12 is a schematic diagram showing the details of the swing-mode selector switch 77. The swing-mode selector switch 77 is arranged in the cab at a position easily coming within sight of the operator. The operator can manually switch the swing-mode selector switch 77. The swing-mode selector switch 77 outputs a prescribed voltage value Vin depending on its switch position. On top of the swing-mode selector switch 77, display lamps named "HYDRAULIC/ELECTRIC COMBINED" and "HYDRAULIC SOLO" are arranged at corresponding switch positions. The display lamp "HYDRAULIC/ELECTRIC COMBINED" lights up green (see FIG. 12A), while the display lamp "HYDRAULIC SOLO" lights up red (see FIG. 12B). With this configuration, the operator is allowed to recognize the currently selected swing mode and prevented from forgetting to set/return the swing-mode selector switch 77.

In this embodiment, the swing-mode selector switch 77 and the input control block 86 constitute swing-mode switching command means.

Operations specific to this embodiment will be explained below.

In normal operation, the swing-mode selector switch 77 is set at the position "HYDRAULIC/ELECTRIC COMBINED" with its green display lamp lit up (FIG. 12A).

Figure 13:
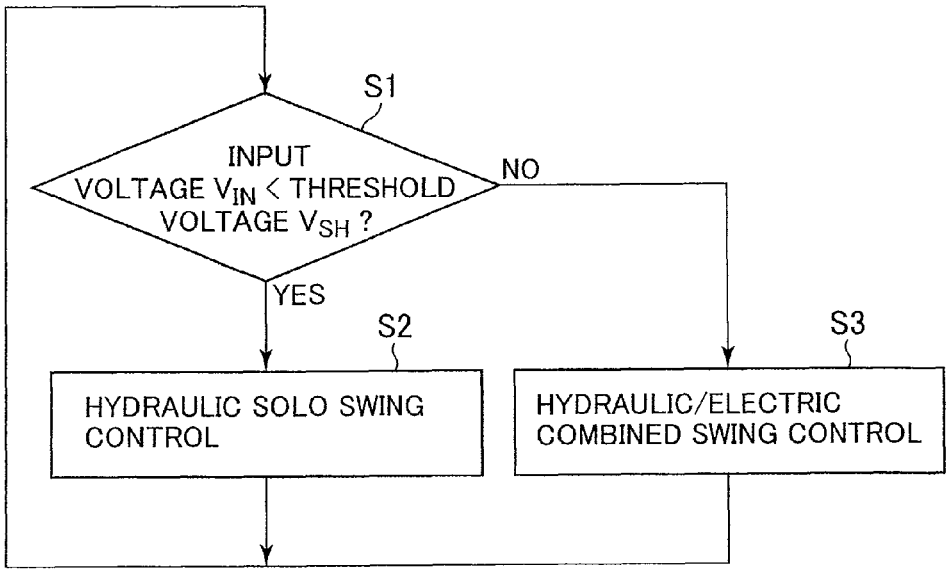
FIG. 13 is a flow chart showing the control flow of an input control block.

FIG. 13 is a flow chart showing the control flow of the input control block 86. The input control block 86 judges whether input voltage Vin is lower than threshold voltage Vsh or not. A command signal corresponding to the hydraulic/electric combined swing position is at a voltage value Voff. In this case, the input control block 86 judges that the input voltage Vin is not lower than the threshold voltage Vsh (NO) and recognizes that the hydraulic/electric combined swing mode has been selected (step S1→S3). The input control block 86 outputs a command signal to the control switching block 85. The control switching block 85 has selected the hydraulic/electric combined swing control block 83.

For specific operations such as the aforementioned crushing operation and swing unloading operation, the operator switches the swing-mode selector switch 77 to the position "HYDRAULIC SOLO". In this state, the display lamp "HYDRAULIC/ELECTRIC COMBINED" turns off and the display lamp "HYDRAULIC SOLO" lights up green (FIG. 12B).

A command signal corresponding to the hydraulic solo swing position is at a voltage value Von. In this case, the input control block 86 judges that the input voltage Vin is lower than the threshold voltage Vsh (YES) and recognizes that the hydraulic solo swing mode has been selected (step S1→S2). The input control block 86 outputs a command signal to the control switching block 85. Accordingly, the control switching block 85 selects the hydraulic solo swing control block 84.

Incidentally, the voltage values have been set to satisfy the following relationship:

voltage value Von<threshold voltage Vsh<voltage value Voff

After finishing the specific operation, the operator returns the swing-mode selector switch 77 to the position "HYDRAULIC/ELECTRIC COMBINED", by which the swing mode is returned from the hydraulic solo swing mode to the hydraulic/electric combined swing mode.

Figure 14A:
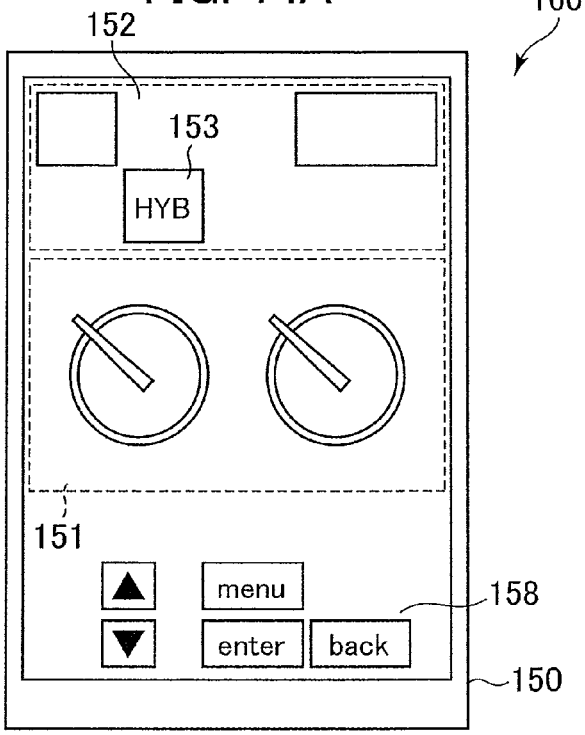
FIG. 14A is a schematic diagram showing a normal display screen (hydraulic/electric combined swing) of a monitor device.
Figure 14B:
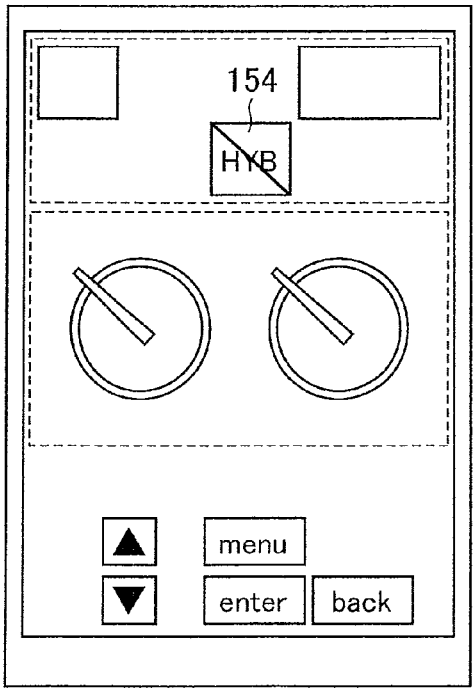
FIG. 14B is a schematic diagram showing the normal display screen (hydraulic solo swing) of the monitor device.

The selected swing mode may be displayed on the monitor device 150 as needed. FIG. 14 shows a normal display screen 160 of the monitor device 150. The monitor device 150 includes, for example, a display area 151 for displaying the status of meters (remaining amount of fuel, engine coolant temperature, etc.) and a display area 152 for displaying a variety of status (time, hour meter, two traveling speeds, E/P/HP mode, operation mode, etc.). When the hydraulic/electric combined swing mode has been selected in the normal operation, the display control block 87 outputs an icon 153 meaning "hybrid control" ("HYB") to the monitor device 150 (see FIG. 14A). When the swing mode is switched to the hydraulic solo swing mode for conducting a specific operation, the display control block 87 extinguishes the icon 153 and outputs an icon 154 meaning "not hybrid control" ("HYB" with a slash) to the monitor device 150 (see FIG. 14B). With the icons 153 and 154, the operator is allowed to recognize the currently selected swing mode and prevented from forgetting to set/return the swing-mode selector switch 77.

A first effect of this embodiment will be explained below.

By the switching command from the swing-mode selector switch 77, the swing mode can be switched between the mode for executing the swing driving with the torque of both the hydraulic motor 27 and the electric motor 25 (hydraulic/electric combined swing mode) and the mode for executing the swing driving with the hydraulic motor 27 alone (hydraulic solo swing mode). In the hydraulic/electric combined swing mode, operational actions specific to the hydraulic actuator (e.g., pressing excavation) and operational feeling specific to the hydraulic actuator can be realized while also achieving energy saving by regenerating the kinetic energy of the swing structure 20 into electric energy through the electric motor 25 at the time of braking (deceleration). By switching the swing mode to the hydraulic solo swing mode, it is also possible to drive the swing structure 20 with normal swing torque using the hydraulic motor 27 alone and continue the operation (work) of the hydraulic shovel.

A second effect of this embodiment will be explained below.

In this embodiment, the abnormality monitoring/abnormality processing control block 81 and the energy management control block 82 execute automatic switching control, whereas the input control block 86 executes manual switching control. The effect of the manual switching control will be explained below while comparing it with the automatic switching control.

In the specific operations, problems related to the capacitor 24 can occur. For example, the capacitor 24 tends to fall into a low energy state in the crushing operation, or into an overcharged state in the swing unloading operation.

When such a problem related to the capacitor 24 occurs, the automatic switching control switches the swing mode from the hydraulic/electric combined swing mode to the hydraulic solo swing mode. After the problem related to the capacitor 24 is eliminated, the automatic switching control returns the swing mode from the hydraulic solo swing mode to the hydraulic/electric combined swing mode. Thus, the aforementioned first effect can be achieved while eliminating the problem related to the capacitor 24.

However, the automatic switching control is incapable of preventing the occurrence itself of the problems related to the capacitor 24, and thus the swing mode can change frequently during operation. Excessive switching of the swing mode puts a heavy load on the controller 80 and is undesirable. Further, while this embodiment is configured to give the operator equal operational feeling in both the hydraulic/electric combined swing mode and the hydraulic solo swing mode, perfect equality is not guaranteed. Excessive switching of the swing mode during operation can give the operator a slight feeling of strangeness.

However, specific operations causing a problem related to the capacitor 24 (crushing operation, swing unloading operation, etc.) can be anticipated previously. When the operator manually switches the swing-mode selector switch 77 before starting a specific operation, the swing mode is switched from the hydraulic/electric combined swing mode to the hydraulic solo swing mode. During the specific operation, the swing mode is fixed at the hydraulic solo swing mode since the manual switching control is prioritized over the automatic switching control. Thus, the occurrence itself of the problems related to the capacitor 24 can be prevented.

Second Embodiment

Figure 15:
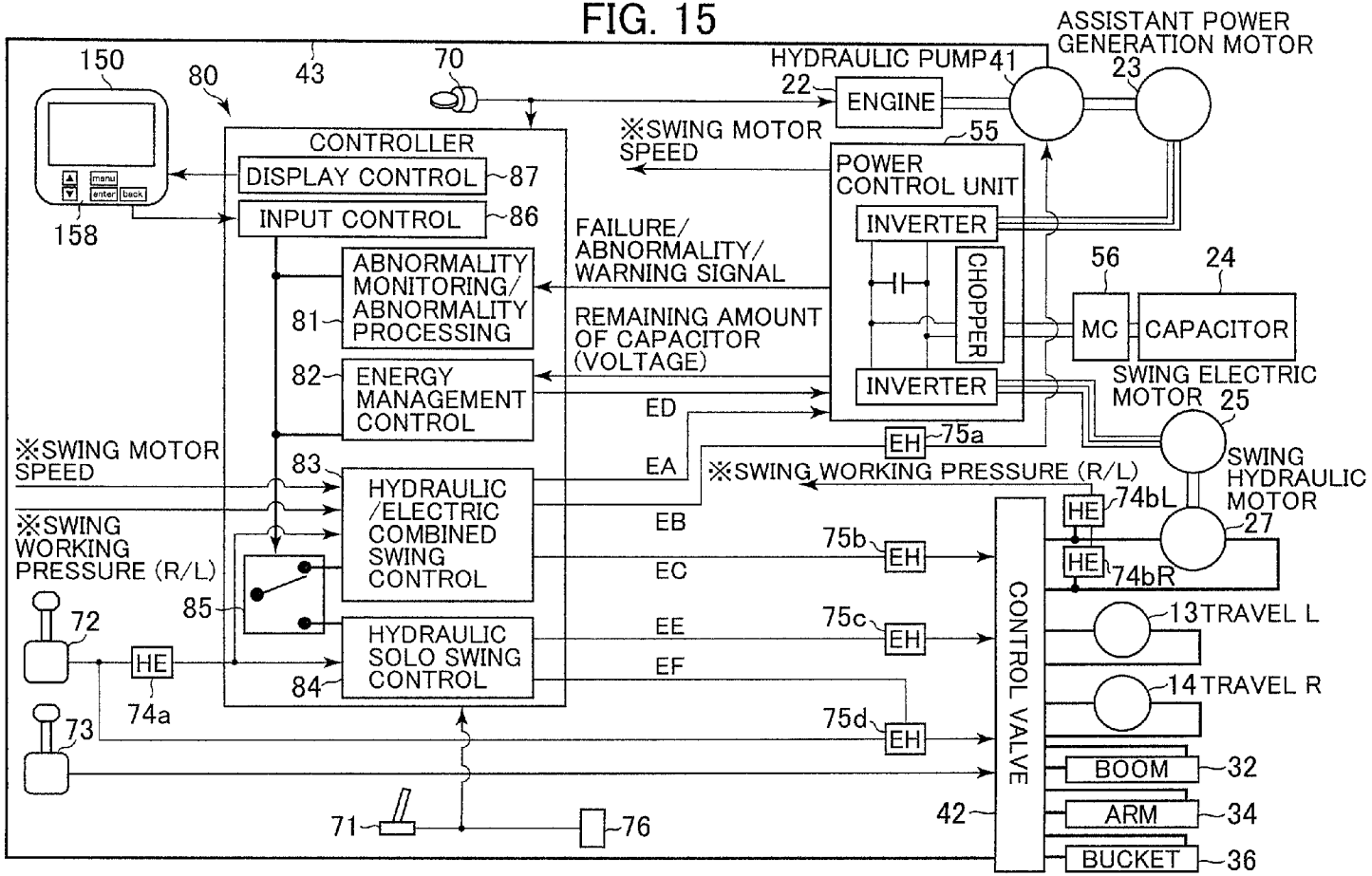
FIG. 15 is a block diagram showing the system configuration and control blocks of a hybrid hydraulic shovel in accordance with a second embodiment of the present invention.

FIG. 15 is a block diagram showing the system configuration and control blocks of a hybrid hydraulic shovel in accordance with a second embodiment of the present invention. In this embodiment, the swing-mode selector switch 77 employed in the first embodiment is left out.

A configuration specific to the second embodiment will be described below.

The monitor device 150 in this embodiment has an operational input unit 158 at the bottom of the display area 152. An input command from the operational input unit 158 is inputted to the input control block 86. Thus, the monitor device 150 has a GUI (Graphical User Interface) function in addition to the display function.

Figure 16:
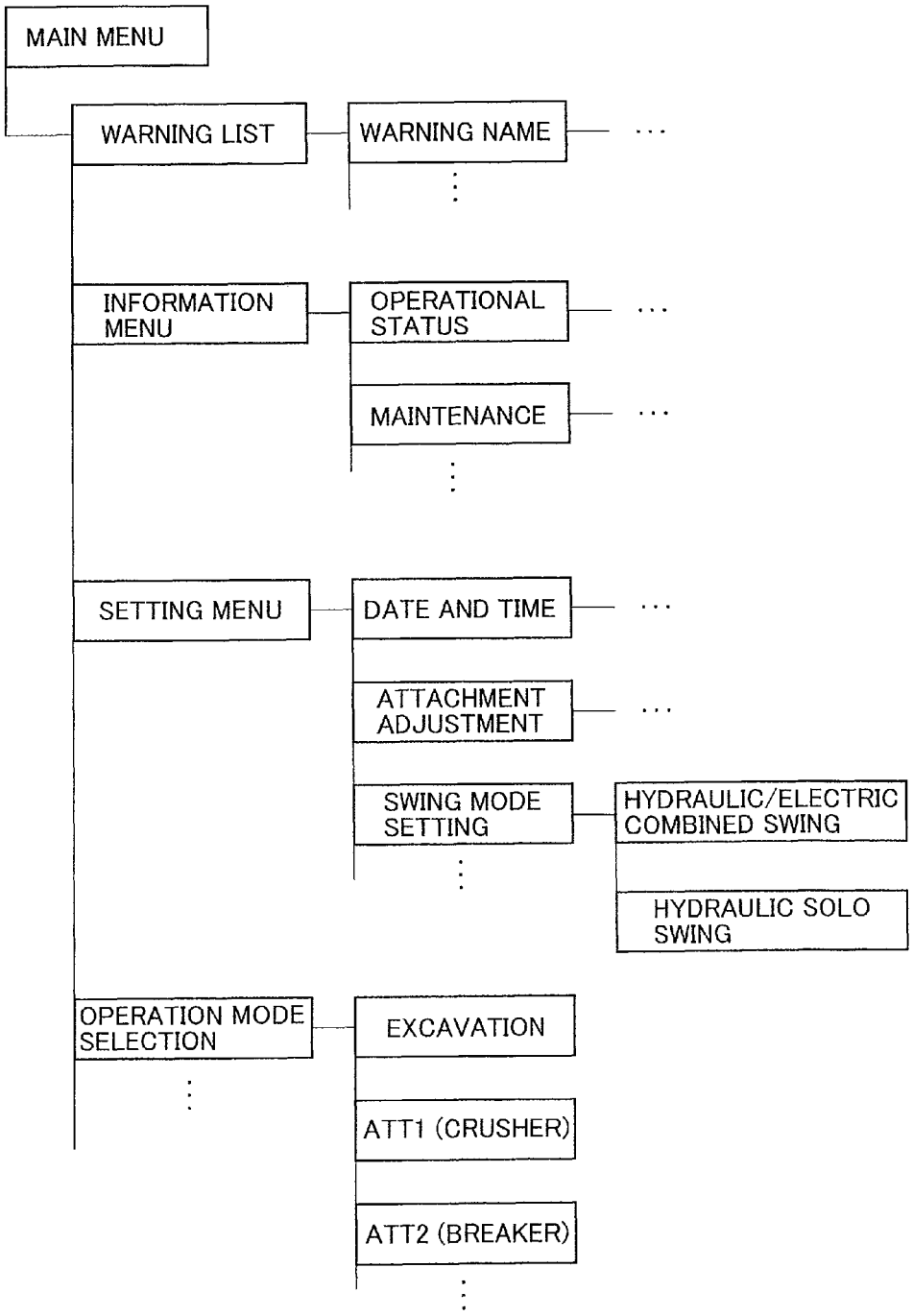
FIG. 16 is a schematic diagram showing the hierarchical structure of screens displayed on the monitor device.
Figure 17A:
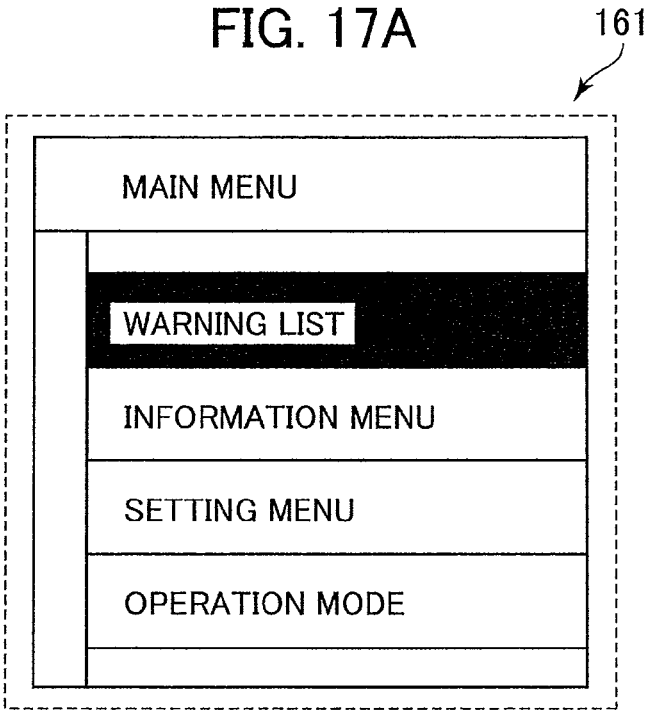
FIG. 17A is a schematic diagram showing a main menu screen (initial state) displayed on the monitor device.

FIG. 16 is a schematic diagram showing the hierarchical structure of screens displayed on the monitor device 150. The display control block 87 loads each screen from a storage unit and outputs the loaded screen to the monitor device 150. Normally, the normal display screen 160 for indicating the status of meters, etc. (see FIG. 14) is displayed. When a menu button in the operational input unit 158 is pressed, a main menu screen 161 (see FIG. 17A) is displayed.

Figure 17B:
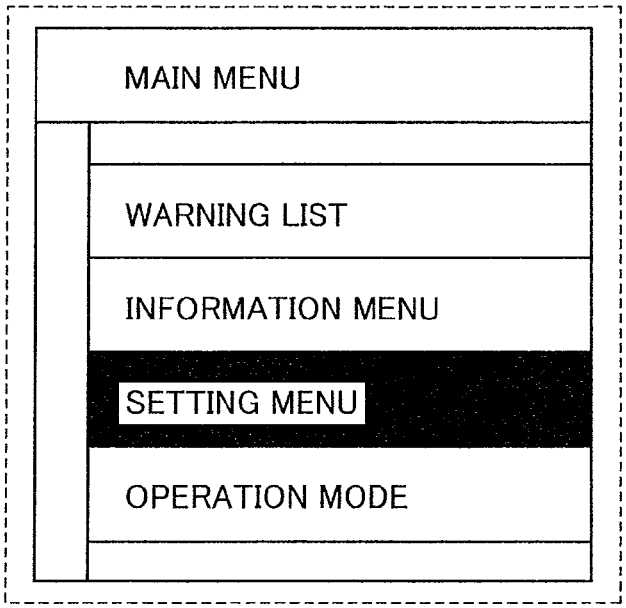
FIG. 17B is a schematic diagram showing the main menu screen (operated state) displayed on the monitor device.
Figure 18A:
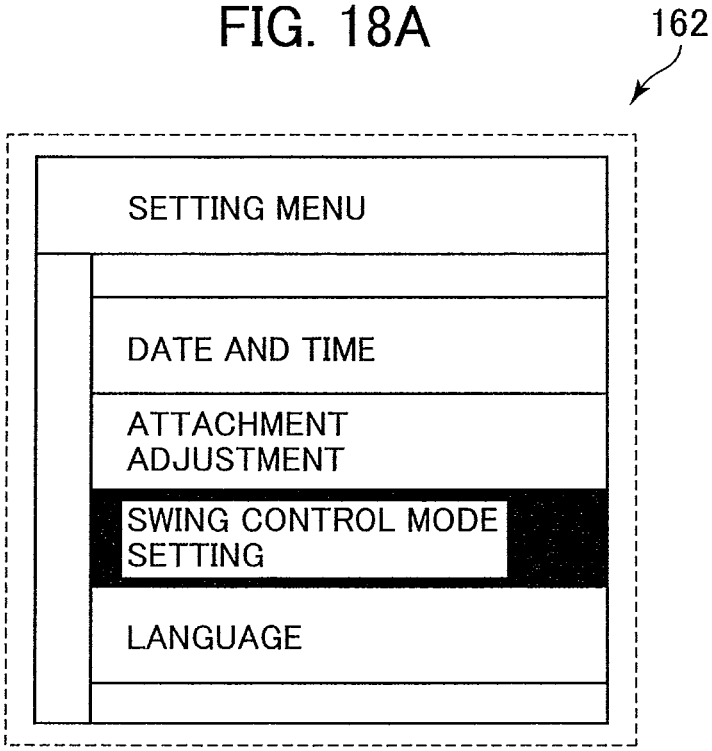
FIG. 18A is a schematic diagram showing a setting menu screen (operated state) displayed on the monitor device.

The main menu screen 161 is made up of various menu items. The operator can select a desired menu item by operating up/down buttons in the operational input unit 158 (see FIG. 17B). When an enter button is pressed after the selection of a menu item, a screen corresponding to the selected menu item is displayed. For example, a setting menu screen 162 (see FIG. 18A) is displayed in response to the selection of the item "SETTING MENU".

Figure 18B:
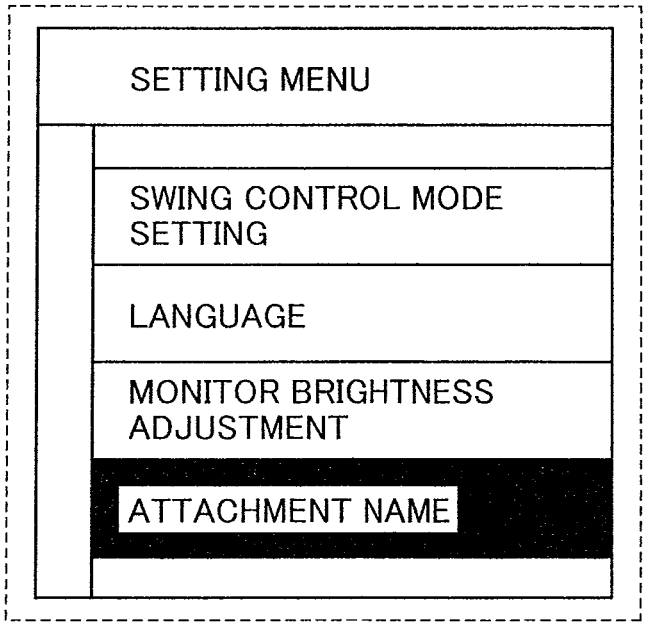
FIG. 18B is a schematic diagram showing the setting menu screen (scrolled state) displayed on the monitor device.
Figure 19:
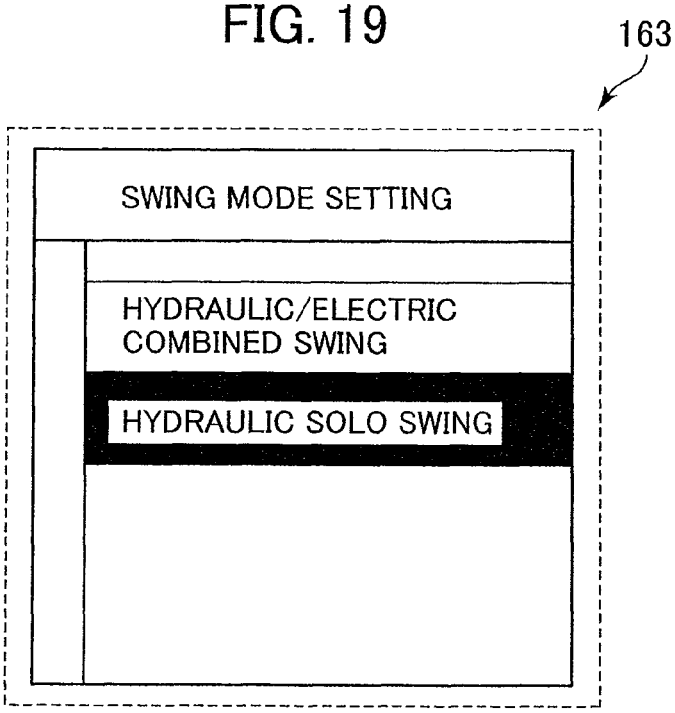
FIG. 19 is a schematic diagram showing a swing-mode setting screen displayed on the monitor device.

The setting menu screen 162 is made up of various menu items. The operator can select a desired menu item by operating the up/down buttons in the operational input unit 158. When there are too many setting items to be displayed together, the screen can be scrolled by operating the up/down buttons (see FIG. 18B). When the enter button is pressed after the selection of a setting item, a screen corresponding to the selected setting item is displayed. The setting items include an item "SWING MODE SETTING" in this embodiment. When the item "SWING MODE SETTING" is selected, a swing-mode setting screen 163 (see FIG. 19) is displayed.

Figure 20:
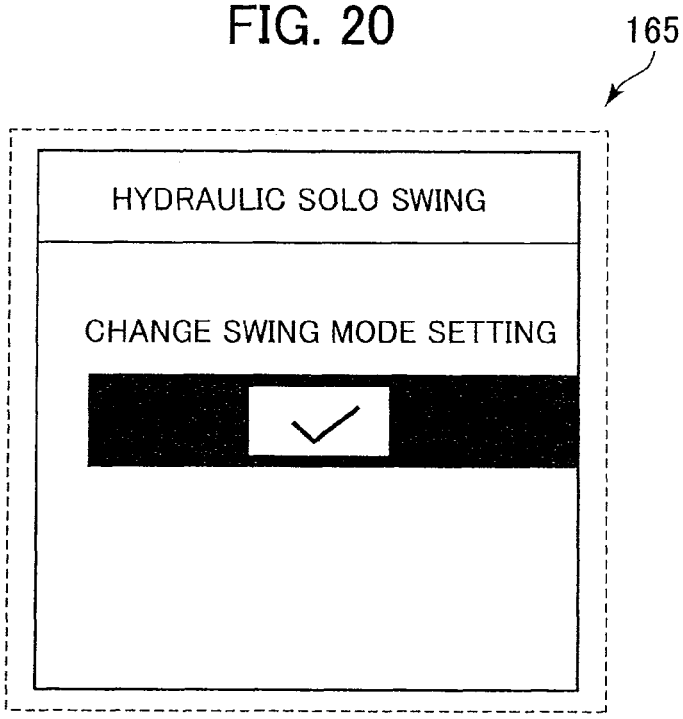
FIG. 20 is a schematic diagram showing a hydraulic solo swing-mode confirmation screen displayed on the monitor device.

The swing-mode setting screen 163 is made up of an item "HYDRAULIC/ELECTRIC COMBINED SWING" and an item "HYDRAULIC SOLO SWING". The operator can select each item by operating the up/down buttons in the operational input unit 158. When the enter button is pressed after the selection of the item "HYDRAULIC/ELECTRIC COMBINED SWING", a hydraulic/electric combined swing-mode confirmation screen 164 (unshown) is displayed. When the enter button is pressed after the selection of the item "HYDRAULIC SOLO SWING", a hydraulic solo swing-mode confirmation screen 165 (see FIG. 20) is displayed.

The hydraulic/electric combined swing-mode confirmation screen 164 has a check box. The operator can select the check box by operating the up/down buttons in the operational input unit 158. When the enter button is pressed after the selection of the check box, the input control block 86 receives the switching command signal for switching the swing mode from the hydraulic solo swing mode to the hydraulic/electric combined swing mode.

The hydraulic solo swing-mode confirmation screen 165 has a check box. The operator can select the check box by operating the up/down buttons in the operational input unit 158. When the enter button is pressed after the selection of the check box, the input control block 86 receives the switching command signal for switching the swing mode from the hydraulic/electric combined swing mode to the hydraulic solo swing mode.

In this embodiment, the swing-mode setting screen 163, the hydraulic/electric combined swing-mode confirmation screen 164, the hydraulic solo swing-mode confirmation screen 165, the operational input unit 158 and the input control block 86 constitute the swing-mode switching command means.

Operations specific to this embodiment will be described below.

The input control block 86 selects the hydraulic/electric combined swing control block 83 as the initial setting and thereby sets the swing mode in the hydraulic/electric combined swing mode. Thus, the hydraulic/electric combined swing mode is selected in normal operation.

For specific operations such as the crushing operation and the swing unloading operation, the operator sets the swing mode in the hydraulic solo swing mode through the swing-mode setting screen 163 and the hydraulic solo swing-mode confirmation screen 165 by operating the operational input unit 158. The input control block 86 outputs the switching command signal to the control switching block 85. Accordingly, the control switching block 85 selects the hydraulic solo swing control block 84.

After finishing the specific operation, the operator returns the swing mode to the hydraulic/electric combined swing mode through the swing-mode setting screen 163 and the hydraulic/electric combined swing-mode confirmation screen 164 by operating the operational input unit 158.

Incidentally, the selected swing mode may be displayed on the monitor device 150 as needed. When the operator presses a back button in the operational input unit 158, the normal display screen 160 is displayed (see FIG. 14). With the icons 153 and 154, the operator is allowed to recognize the currently selected swing mode and prevented from forgetting to set/return the swing mode.

Also in this embodiment, the first and second effects of the first embodiment are achieved.

Third Embodiment

Figure 21:
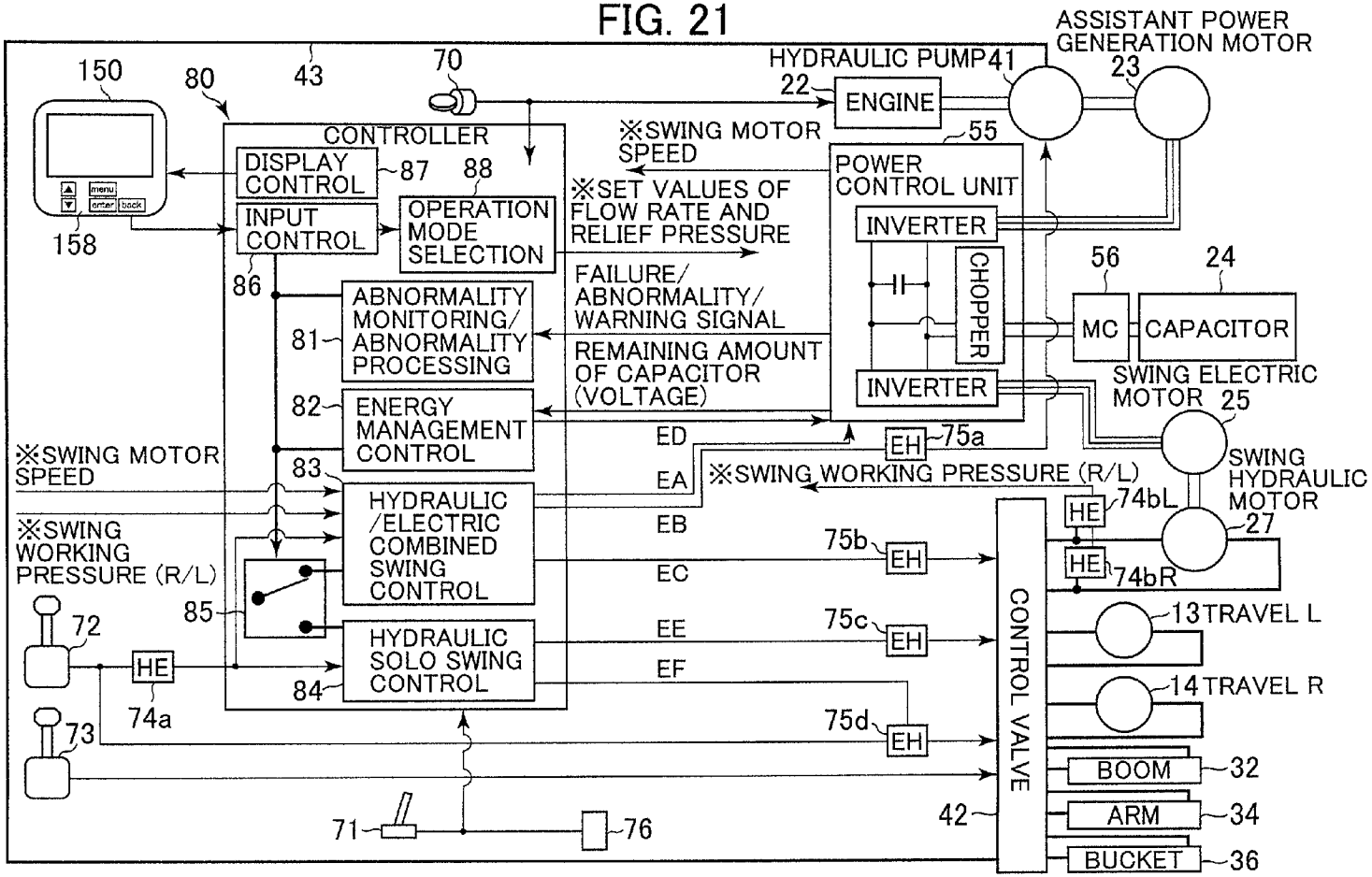
FIG. 21 is a block diagram showing the system configuration and control blocks of a hybrid hydraulic shovel in accordance with a third embodiment of the present invention.

FIG. 21 is a block diagram showing the system configuration and control blocks of a hybrid hydraulic shovel in accordance with a third embodiment of the present invention. In this embodiment, operation mode selection means is added to the second embodiment.

First, the operation mode selection means will be explained. While the hydraulic shovel normally carries out excavation by using the bucket 35 (normal operation), the attachment (front work implement) is replaced with various attachments depending on the type of operation. For the crushing operation, for example, the bucket 35 of the hydraulic shovel is replaced with a crusher (crusher attachment). Other attachments include a breaker, a clam shell, etc. These attachments have relief pressure, maximum pump flow rate, etc. that are optimum for each operation. Since relief pressure, maximum pump flow rate, etc. optimum for the excavation have been set as the initial setting, the relief pressure, maximum pump flow rate, etc. have to be reset when the attachment is replaced. The hierarchical structure of the screens displayed on the monitor device 150 (see FIG. 16) includes an item "OPERATION MODE SELECTION". The monitor device 150 has the GUI function in addition to the display function similarly to that in the second embodiment (see FIG. 15). Thus, the input command from the operational input unit 158 is inputted to the input control block 86.

Figure 22:
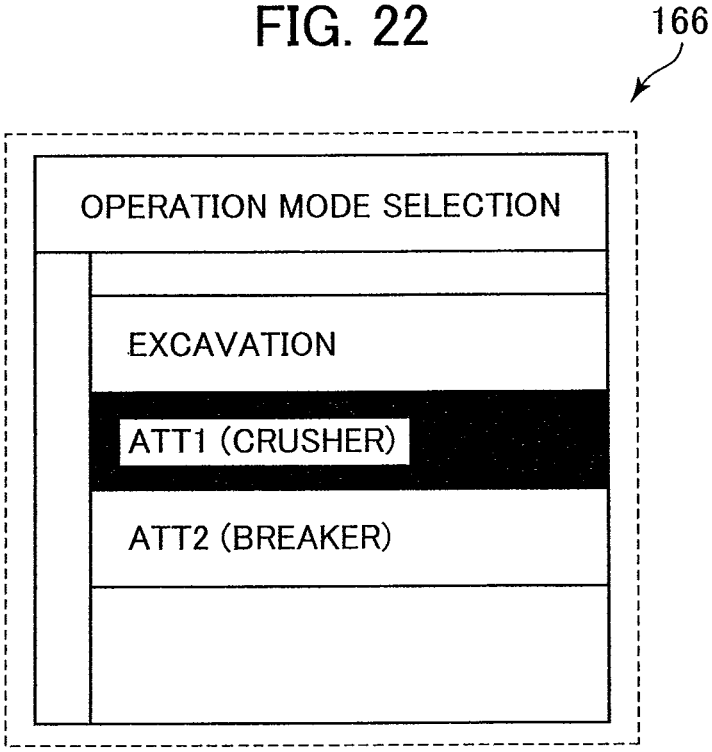
FIG. 22 is a schematic diagram showing an operation mode selection screen displayed on the monitor device.
Figure 23A:
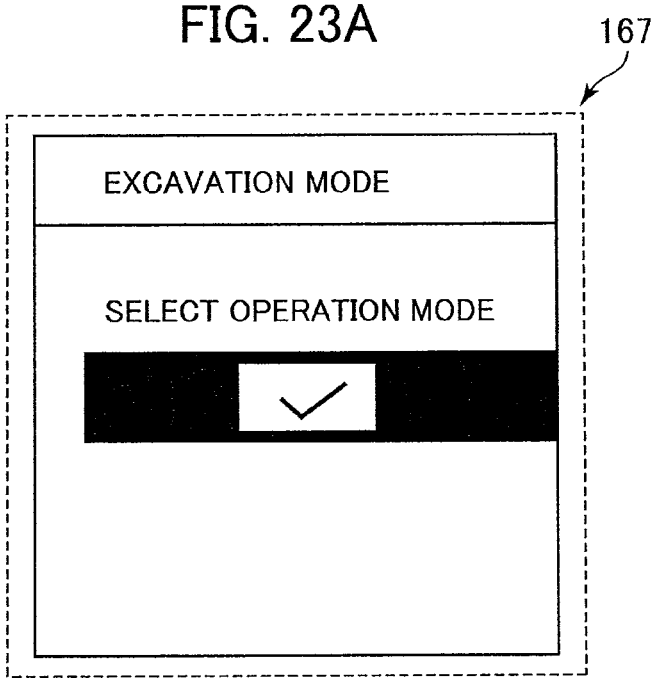
FIG. 23A is a schematic diagram showing a mode selection confirmation screen (excavation mode) displayed on the monitor device.
Figure 23B:
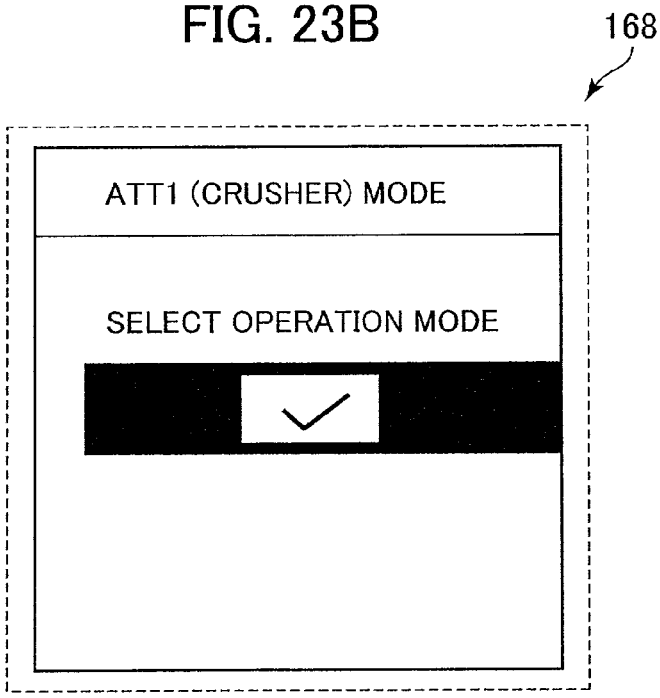
FIG. 23B is a schematic diagram showing a mode selection confirmation screen (crushing mode) displayed on the monitor device.

When the item "OPERATION MODE SELECTION" is selected on the main menu screen 161 (see FIG. 17), an operation mode selection screen 166 (see FIG. 22) is displayed. The operation mode selection screen 166 is made up of various operation mode selection items. The operator can select a desired operation mode selection item by operating the up/down buttons in the operational input unit 158. When the enter button is pressed after the selection of an operation mode selection item, a confirmation screen corresponding to the selected operation mode selection item is displayed. The operation mode selection items include an "EXCAVATION" mode selection item, an "ATT1 (CRUSHER)" mode selection item, an "ATT2 (BREAKER)" mode selection item, etc. The "ATT1 (CRUSHER)" means the crushing operation in which the crusher (crusher attachment) is selected as the attachment. The "ATT2 (BREAKER)" means chipping operation in which the breaker is selected as the attachment. When the enter button is pressed after the selection of the "EXCAVATION" mode selection item, an excavation mode selection confirmation screen 167 (see FIG. 23A) is displayed. When the enter button is pressed after the selection of the "ATT1 (CRUSHER)" mode selection item, a crushing mode selection confirmation screen 168 (see FIG. 23B) is displayed.

The confirmation screens (e.g., the crushing mode selection confirmation screen 168) have a check box. The operator can select the check box by operating the up/down buttons in the operational input unit 158. When the enter button is pressed after the selection of the check box, the input control block 86 receives an operation mode selection command.

The controller 80 includes an operation mode selection block 88. The operation mode selection block 88 prestores set values of the relief pressure, maximum pump flow rate, etc. optimum for the attachment used for the operation in each operation mode. The operation mode selection block 88 receives the operation mode selection command and outputs a setting command corresponding to the set values to the regulator 64 and the relief valves 62*a* and 62*b*. With this operation, the relief pressure, maximum pump flow rate, etc. optimum for the attachment can be set.

Incidentally, the operation mode selection block 88 selects the excavation mode as the operation mode of the initial setting.

A configuration specific to the third embodiment will be described below.

As mentioned above, when the enter button is pressed after the selection of the check box on the excavation mode selection confirmation screen 167, the operation mode selection block 88 receives an excavation mode selection command via the input control block 86 and outputs a setting command that is suitable for the bucket used for the excavation. In this embodiment, the operation mode selection block 88 further stores a switching command for switching the swing mode from the hydraulic solo swing mode to the hydraulic/electric combined swing mode in response to the selection of the excavation mode. Upon receiving the excavation mode selection command, the operation mode selection block 88 outputs the switching command signal to the control switching block 85.

When the enter button is pressed after the selection of the check box on the crushing mode selection confirmation screen 168, the operation mode selection block 88 receives a crushing mode selection command via the input control block 86 and outputs a setting command that is suitable for the crusher (crusher attachment) used for the crushing operation. In this embodiment, the operation mode selection block 88 further stores a switching command for switching the swing mode from the hydraulic/electric combined swing mode to the hydraulic solo swing mode in response to the selection of the crushing mode. Upon receiving the crushing mode selection command, the operation mode selection block 88 outputs the switching command signal to the control switching block 85.

In this embodiment, the excavation mode selection confirmation screen 167, the crushing mode selection confirmation screen 168, the operational input unit 158, the input control block 86 and the operation mode selection block 88 constitute the swing-mode switching command means.

Operations specific to this embodiment will be described below. A case where the crushing mode (in which the crusher is used as the attachment) is selected will be explained.

The operation mode selection block 88 selects the excavation mode as the initial setting and thereby sets the swing mode in the hydraulic/electric combined swing mode. Thus, the hydraulic/electric combined swing mode is selected in normal operation.

Figure 24A:
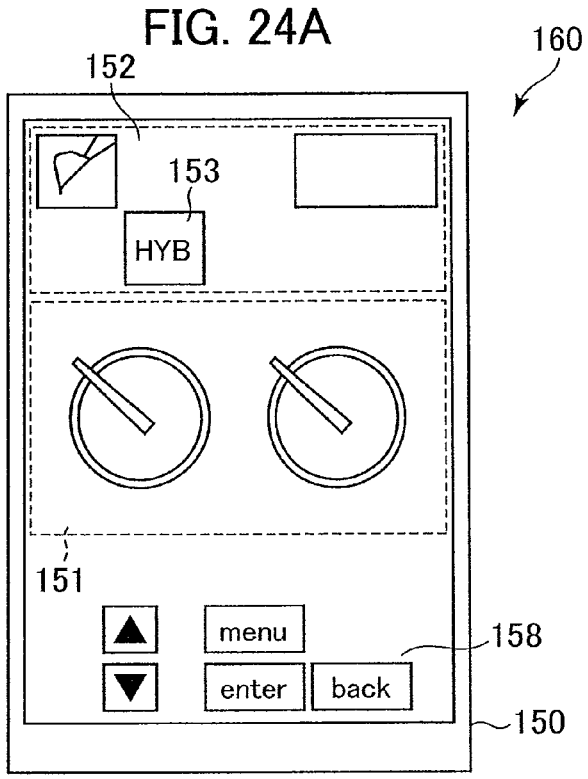
FIG. 24A is a schematic diagram showing the normal display screen (hydraulic/electric combined swing) of the monitor device.
Figure 24B:
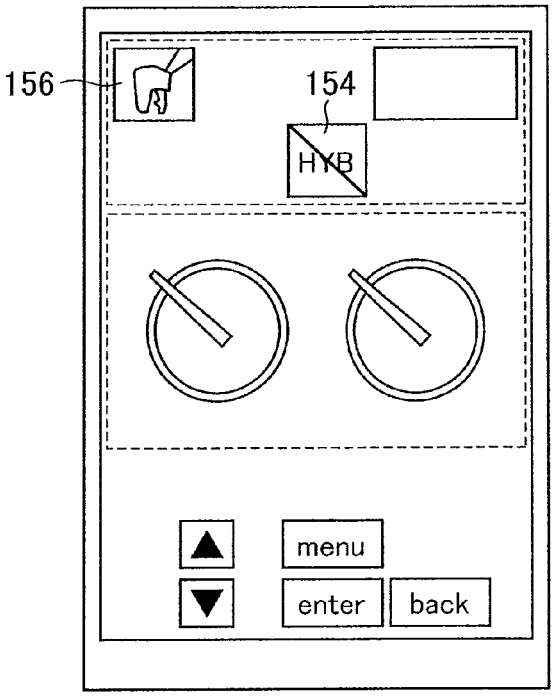
FIG. 24B is a schematic diagram showing the normal display screen (hydraulic solo swing) of the monitor device.

FIG. 24 shows the normal display screen 160 of the monitor device 150. In this case, the display control block 87 outputs an icon 155 indicating that the selected operation mode is the excavation mode (symbol of the bucket) and the icon 153 meaning "hybrid control" ("HYB") to the monitor device 150 (see FIG. 24A).

For the crushing operation, the operator replaces the bucket 35 with the crusher and selects the crushing mode through the operation mode selection screen 166 and the crushing mode selection confirmation screen 168 by operating the operational input unit 158. The operation mode selection block 88 outputs the switching command signal to the control switching block 85. Accordingly, the control switching block 85 selects the hydraulic solo swing control block 84.

When the operator presses the back button in the operational input unit 158, the normal display screen 160 is displayed. In this case, the display control block 87 outputs an icon 156 indicating that the selected operation mode is the crushing mode (symbol of the crusher attachment) and the icon 154 meaning "not hybrid control" ("HYB" with a slash) to the monitor device 150 (see FIG. 24B).

After finishing the crushing operation, the operator returns the attachment from the crusher to the bucket 35 and selects the excavation mode through the operation mode selection screen 166 and the excavation mode selection confirmation screen 167 by operating the operational input unit 158. The operation mode selection block 88 outputs the switching command signal to the control switching block 85. Accordingly, the control switching block 85 returns the swing mode to the hydraulic/electric combined swing mode by selecting the hydraulic/electric combined swing control block 83.

Effect of this embodiment will be explained below.

In the crushing operation employing the crusher as the attachment, the energy necessary for the swing driving is high due to the heavy weight of the crusher, whereas the energy that can be recovered and collected in the capacitor 24 during braking is low due to low kinetic energy of the upper swing structure 20 swinging slowly during the crushing operation. Thus, continuing the crushing operation for a long time in the hydraulic/electric combined swing mode causes the capacitor 24 to fall into the low energy state.

In this embodiment, when the operator selects the crushing mode through the display screens on the monitor device 150, the swing mode is switched from the hydraulic/electric combined swing mode to the hydraulic solo swing mode, by which effect similar to that of the first embodiment is achieved.

Extra effect of this embodiment will be explained below.

In the first embodiment implemented by the manual switching control, the operator can forget to set/return the swing mode.

In this embodiment, when the operator manually selects the operation mode, the operation mode selection block 88 automatically switches the swing mode, which can be called semiautomatic (semi-manual) switching control. With this control, the operator is more securely prevented from forgetting to set/return the swing mode.

While a case where the crushing mode (in which the crusher is used as the attachment) is selected has been explained in this embodiment, this embodiment is not to be restricted to the crushing mode. For example, the swing mode may be switched to the hydraulic solo swing mode when the chipping mode (in which the breaker is used as the attachment) is selected.

Fourth Embodiment

Figure 25:
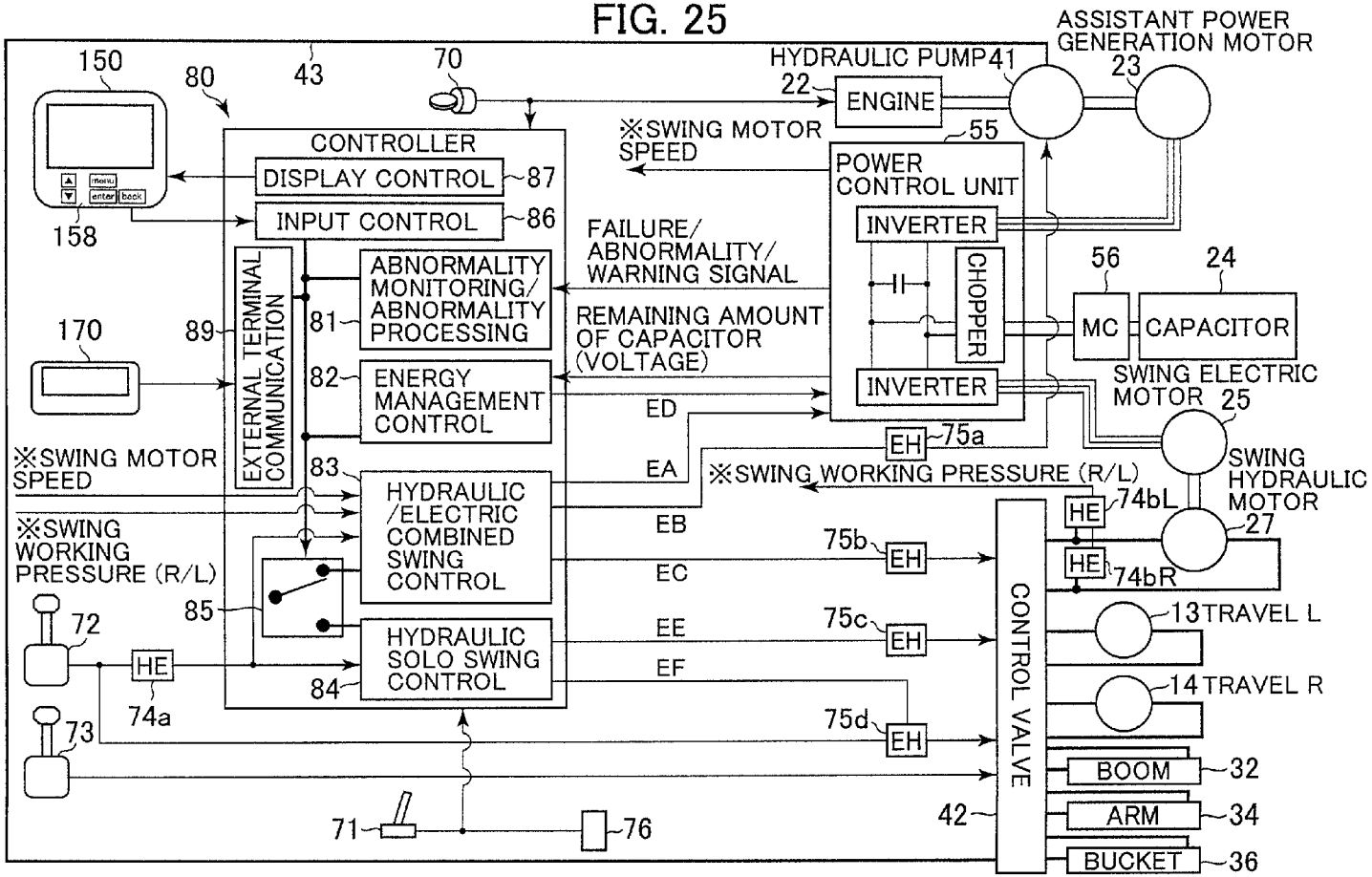
FIG. 25 is a block diagram showing the system configuration and control blocks of a hybrid hydraulic shovel in accordance with a fourth embodiment of the present invention.

FIG. 25 is a block diagram showing the system configuration and control blocks of a hybrid hydraulic shovel in accordance with a fourth embodiment of the present invention. In this embodiment, the swing-mode selector switch 77 in the first embodiment is left out and an external terminal 170 and a configuration accompanying the external terminal 170 (external terminal communication block 89) are added.

First, the external terminal 170 will be explained. The hydraulic shovel needs periodic maintenance. The service person connects the external terminal 170 to the controller 80, acquires data accumulated in the controller 80 via the external terminal communication block 89, and makes failure diagnosis. Further, the service person makes various setting changes based on the result of the failure diagnosis.

A configuration specific to the fourth embodiment will be described below.

The external terminal 170 has functions for making various setting changes even at times other than failure diagnosis. As one of the functions, the external terminal 170 has a swing-mode switching function. The external terminal communication block 89 receives the switching command signal from the external terminal 170 and outputs the signal to the control switching block 85.

In this embodiment, the external terminal 170 and the external terminal communication block 89 constitute the swing-mode switching command means.

Operations specific to this embodiment will be described below.

In normal operation, the swing mode is set in the hydraulic/electric combined swing mode as the initial setting. The control switching block 85 has selected the hydraulic/electric combined swing control block 83.

When it is already known that the specific operations (crushing operation, swing unloading operation, etc.) will be conducted frequently, the service person sets the swing mode in the hydraulic solo swing mode through the external terminal 170. The external terminal communication block 89 outputs the switching command signal to the control switching block 85. Accordingly, the control switching block 85 selects the hydraulic solo swing control block 84.

After the specific operations are finished, the service person returns the swing mode to the hydraulic/electric combined swing mode through the external terminal 170.

Also in this embodiment, the effects of the first embodiment are achieved.

Extra effect of this embodiment will be explained below.

The first embodiment is implemented by the manual switching control based on the judgment by the operator. However, the operator can be not thoroughly familiar with the characteristics of the hybrid hydraulic shovel and inappropriate switching of the swing mode can cause failure of the hydraulic shovel. Further, skilled operators accustomed to the operational feeling of conventional (non-hybrid) hydraulic shovels can have a slight feeling of strangeness on the hydraulic/electric combined swing mode and fix the swing mode at the hydraulic solo swing mode even during normal operation. The fixation of the swing mode at the hydraulic solo swing mode during normal operation disables the effect achieved through energy saving.

This embodiment is implemented by the manual switching control based on the judgment by the service person. The service person, thoroughly familiar with the characteristics of the hybrid hydraulic shovel, appropriately switches the swing mode, by which the effects of the first embodiment are achieved more reliably.

Incidentally, the selected swing mode may be displayed on the monitor device 150 as needed (see FIG. 14). With the icons 153 and 154, the operator is allowed to recognize the currently selected swing mode even when the swing mode has been selected by the service person.

Fifth Embodiment

Figure 26:
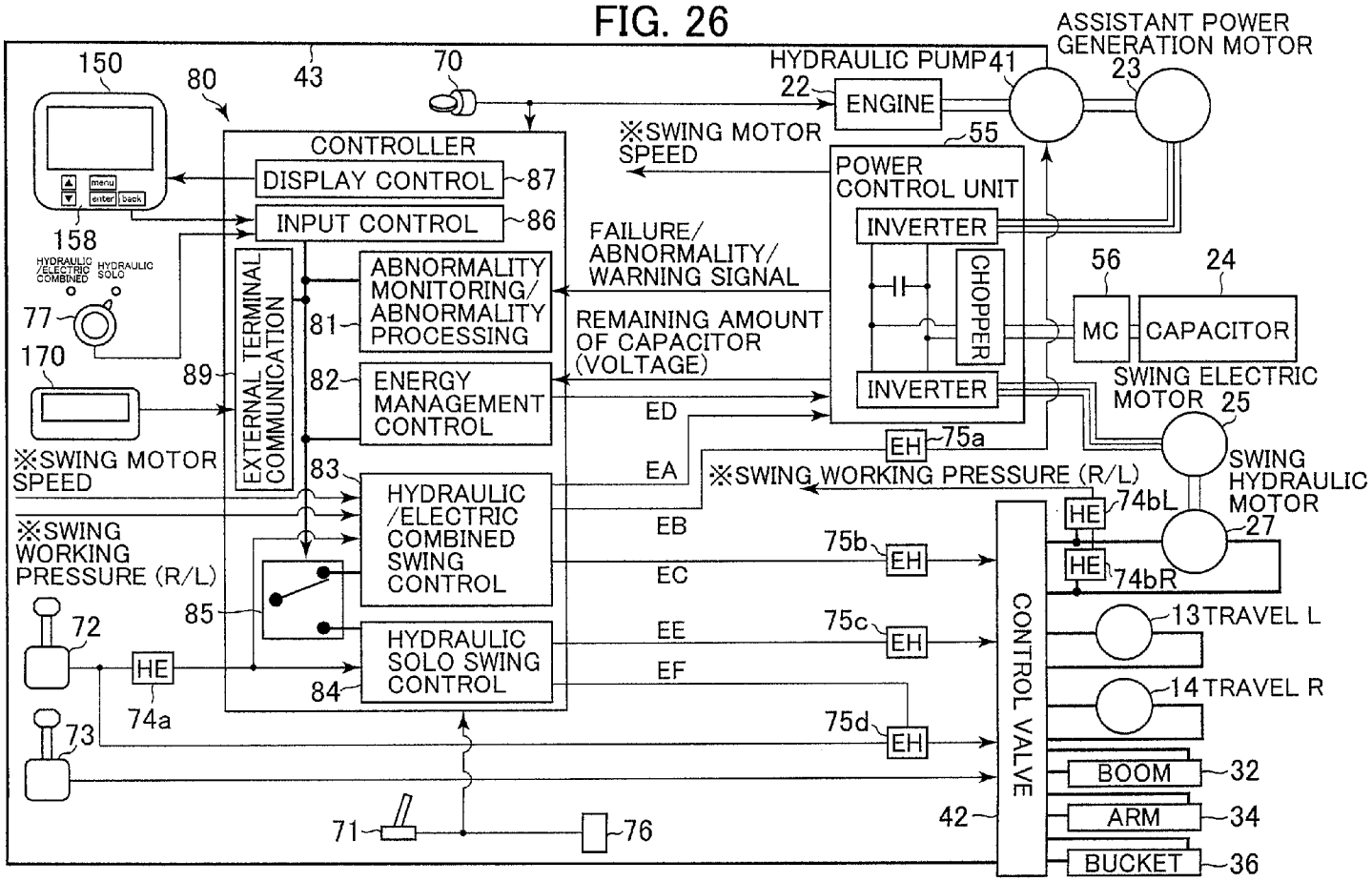
FIG. 26 is a block diagram showing the system configuration and control blocks of a hybrid hydraulic shovel in accordance with a fifth embodiment of the present invention.

FIG. 26 is a block diagram showing the system configuration and control blocks of a hybrid hydraulic shovel in accordance with a fifth embodiment of the present invention. In this embodiment, the external terminal 170 and the configuration accompanying the external terminal 170 are added to the first embodiment. In short, this embodiment is configured by combining the first embodiment and the fourth embodiment.

A configuration specific to the fifth embodiment will be described below.

The input control block 86 receives a switching command signal from the swing-mode selector switch 77 and outputs the signal to the control switching block 85. Meanwhile, the external terminal communication block 89 receives another switching command signal from the external terminal 170, invalidates the switching command signal from the swing-mode selector switch 77, and outputs the switching command signal received from the external terminal 170 to the control switching block 85. In other words, the switching command signal from the external terminal 170 is prioritized over the switching command signal from the swing-mode selector switch 77.

In this embodiment, the swing-mode selector switch 77 and the input control block 86 constitute the swing-mode switching command means, and the external terminal 170 and the external terminal communication block 89 constitute second swing-mode switching command means.

Operations specific to this embodiment will be described below.

When the operator is thoroughly familiar with the characteristics of the hybrid hydraulic shovel, the manual switching control based on the judgment by the operator is carried out. In this case, there is no operation caused by the service person. In short, the operation of the hybrid hydraulic shovel is equivalent to that in the first embodiment.

When the operator is not thoroughly familiar with the characteristics of the hybrid hydraulic shovel, the manual switching control based on the judgment by the service person is carried out. In this case, the operation of the hybrid hydraulic shovel is equivalent to that in the fourth embodiment. After the swing mode is switched by the service person through the external terminal 170, the switching command signal from the swing-mode selector switch 77 is invalidated even when the swing-mode selector switch 77 is operated by the operator.

Incidentally, the fact that the switching commands from the swing-mode selector switch 77 have been invalidated may be displayed on the monitor device 150 as needed.

In this embodiment, the manual switching control based on the judgment by the operator and the manual switching control based on the judgment by the service person are both possible.

While this embodiment has been configured by combining the first embodiment and the fourth embodiment, it is also possible to combine the second embodiment and the fourth embodiment.

<Modifications>

The assistant power generation motor 23, connected to the drive shaft of the engine 22 in the above embodiments, may be replaced with a hydraulic motor driven by the hydraulic fluid discharged from the hydraulic pump 41 and an electric motor connected to the drive shaft of the hydraulic motor. The electricity storage device can be implemented not only by the electric double layer capacitor 24 but also by a variety of devices capable of storing electricity such as a lithium-ion capacitor, a lithium-ion battery and a nickel hydride battery.

While the engine 22 is employed as the prime mover in the above embodiments, the present invention is applicable also to hydraulic shovels employing a different prime mover (e.g., electric motor) with no problem. Such hydraulic shovels employing an electric motor may include a hydraulic shovel employing an electric motor 120 driven by AC power from a commercial AC power supply 121 and a hydraulic shovel employing an electric motor driven by a high-capacity battery.

While embodiments as application of the present invention to hydraulic shovels have been described above, the essence of the present invention is to enable the manual switching control between the hydraulic/electric combined swing mode and the hydraulic solo swing mode for the driving of the swing structure. Therefore, the present invention is applicable also to a wide variety of other construction machines having a swing structure.

DESCRIPTION OF REFERENCE CHARACTERS

10 lower travel structure
11 crawler
12 crawler frame
13 left travel hydraulic motor
14 right travel hydraulic motor
20 upper swing structure
21 swing frame
22 engine
23 assistant power generation motor
24 capacitor
25 swing electric motor
26 deceleration device
27 swing hydraulic motor
30 shovel device (front implement)
31 boom
32 boom cylinder
33 arm
34 arm cylinder
35 bucket
36 bucket cylinder
40 hydraulic system
41 hydraulic pump
42 control valve
43 hydraulic line
51 chopper
52 inverter for the swing electric motor
53 inverter for the assistant power generation motor
54 smoothing capacitor
55 power control unit
56 main contactor
57 main relay
58 inrush current prevention circuit
61 swing spool
62*a*, 62*b* variable overload relief valve
63 center bypass cut valve
70 ignition key
71 gate lock lever
72 swing control lever device
73 control lever device (for operations other than swinging)
74*a*, 74*b*L, 74*b*R hydraulic-electric conversion unit
75*a*, 75*b*, 75*c*, 75*d* electric-hydraulic conversion unit
76 pilot pressure signal shutoff valve
77 swing-mode selector switch
80 controller (control device)
81 abnormality monitoring/abnormality processing control block
82 energy management control block
83 hydraulic/electric combined swing control block
84 hydraulic solo swing control block
85 control switching block
86 input control block
87 display control block
88 operation mode selection block
89 external terminal communication block
150 monitor device
151, 152 display area
153-156 icon
158 operational input unit
160 normal display screen
161 main menu screen
162 setting menu screen

163 swing-mode setting screen
164 hydraulic/electric combined swing-mode confirmation screen
165 hydraulic solo swing-mode confirmation screen
166 operation mode selection screen
167 excavation mode selection confirmation screen
168 crushing mode selection confirmation screen
170 external terminal

The invention claimed is:

1. A hybrid construction machine comprising:
a prime mover;
a hydraulic pump which is driven by the prime mover;
a swing structure;
an electric motor which drives the swing structure;
a hydraulic motor which drives the swing structure, the hydraulic motor being driven by the hydraulic pump;
an electricity storage device which is connected to the electric motor;
a swing control lever device which is operated to command the driving of the swing structure;
swing-mode switching command means which is manually operated to select one of
a hydraulic/electric combined swing mode and
a hydraulic solo swing mode; and
a control device which drives the swing structure using both a torque of the electric motor and a torque of the hydraulic motor by driving both the electric motor and the hydraulic motor when the swing control lever device is operated and the hydraulic/electric combined swing mode is selected by the swing-mode switching command means,
and drives the swing structure using only the torque of the hydraulic motor by driving only the hydraulic motor when the swing control lever device is operated and the hydraulic solo swing mode is selected by the swing-mode switching command means.

2. The hybrid construction machine according to claim 1, wherein
the swing-mode switching command means includes a selector switch which is arranged in a cab.

3. The hybrid construction machine according to claim 2, further comprising a display device,
wherein the control device further displays on the display device the swing mode as the result of the switching based on a command input through the selector switch.

4. The hybrid construction machine according to claim 1, further comprising a display device having an operational input unit, wherein:
the control device further displays on the display device a swing-mode selection screen which enables selection of the swing mode through the operational input unit, and
the swing-mode switching command means includes the swing-mode selection screen displayed on the display device and the operational input unit of the display device.

5. The hybrid construction machine according to claim 4, wherein the control device further displays on the display device the swing mode as the result of the switching based on a command input through the operational input unit.

6. The hybrid construction machine according to claim 1, wherein the swing-mode switching command means includes an operation mode selection means.

7. The hybrid construction machine according to claim 1, wherein:
the swing-mode switching command means includes an external terminal which is connected to the control device.

8. The hybrid construction machine according to claim 1, further comprising an external terminal which is connected to the control device and is operated to select one of the hydraulic/electric combined swing mode and the hydraulic solo swing mode, wherein
the control device invalidates the command from the swing mode switching command means and drives the swing structure using both the torque of the electric motor and the torque of the hydraulic motor by driving both the electric motor and the hydraulic motor when the hydraulic combined swing mode is selected by the external terminal,
and invalidates the command from the swing mode switching command means and drives the swing structure using only the torque of the hydraulic motor by driving only the hydraulic motor when the swing control lever device is operated and the hydraulic solo swing mode is selected by the external terminal.

9. The hybrid construction machine according to claim 4, wherein:
the control device further includes an external terminal communication unit which executes input from and output to an external terminal, and
the hybrid construction machine further comprises a second swing-mode switching command means which commands the switching between the hydraulic/electric combined swing mode and the hydraulic solo swing mode while invalidating the command from the swing-mode switching command means via the external terminal communication unit.

10. The hybrid construction machine according to claim 6, wherein:
the control device further includes an external terminal communication unit which executes input from and output to an external terminal, and
the hybrid construction machine further comprises a second swing-mode switching command means which commands the switching between the hydraulic/electric combined swing mode and the hydraulic solo swing mode while invalidating the command from the swing-mode switching command means via the external terminal communication unit.

11. The hybrid construction machine according to claim 1, wherein the control device makes a correction of increasing the drive torque of the hydraulic motor and a correction of increasing the braking torque of the hydraulic motor when the hydraulic solo swing mode is selected by the swing mode switch command means.

* * * * *